US008878828B2

(12) United States Patent
Baek et al.

(10) Patent No.: US 8,878,828 B2
(45) Date of Patent: Nov. 4, 2014

(54) DISPLAY DRIVER CIRCUITS HAVING MULTI-FUNCTION SHARED BACK CHANNEL AND METHODS OF OPERATING SAME

(75) Inventors: Dong-Hoon Baek, Seoul (KR); JaeYoul Lee, Hwaseong-si (KR)

(73) Assignee: Samsung Electronics Co., Ltd. (KR)

( * ) Notice: Subject to any disclaimer, the term of this patent is extended or adjusted under 35 U.S.C. 154(b) by 255 days.

(21) Appl. No.: 13/371,601

(22) Filed: Feb. 13, 2012

(65) Prior Publication Data

US 2013/0076703 A1 Mar. 28, 2013

(30) Foreign Application Priority Data

Sep. 23, 2011 (KR) ..... 10-2011-0096478

(51) Int. Cl.
*G09G 5/00* (2006.01)
*G09G 3/20* (2006.01)

(52) U.S. Cl.
CPC ..... *G09G 3/20* (2013.01)
USPC ..... 345/204; 714/704

(58) Field of Classification Search
CPC ..... G09G 5/008; G09G 2300/0819; G09G 2310/0275; G09G 2330/12; H04L 7/0004; H04L 7/0016
USPC ..... 714/704
See application file for complete search history.

(56) References Cited

U.S. PATENT DOCUMENTS

| | | | | |
|---|---|---|---|---|
| 7,259,742 | B2 | 8/2007 | Chang et al. | |
| 7,737,939 | B2 | 6/2010 | Shin et al. | |
| 2006/0220992 | A1 * | 10/2006 | Tanaka et al. | 345/60 |
| 2008/0043731 | A1 * | 2/2008 | Lim et al. | 370/389 |
| 2010/0225637 | A1 | 9/2010 | Jeon et al. | |
| 2011/0037758 | A1 | 2/2011 | Lim et al. | |
| 2011/0234574 | A1 | 9/2011 | Tanaka et al. | |
| 2012/0242628 | A1 * | 9/2012 | Yuan et al. | 345/204 |
| 2013/0036335 | A1 * | 2/2013 | Kim et al. | 714/704 |

FOREIGN PATENT DOCUMENTS

| | | |
|---|---|---|
| JP | 2010-107933 | 5/2010 |
| JP | 2010-204667 | 9/2010 |
| KR | 10-2010-0099927 A | 9/2010 |
| KR | 10-2011-0021386 A | 3/2011 |

* cited by examiner

*Primary Examiner* — Sumati Lefkowitz
*Assistant Examiner* — Robin Mak
(74) *Attorney, Agent, or Firm* — Myers Bigel Sibley & Sajovec, PA

(57) ABSTRACT

Display driver circuits include a multi-function driver, which is configured to support first and second modes of operation. The multi-function driver supports the first mode of operation in response to a first control signal by driving a bus with an output signal, which has a value that indicates a locked or unlocked status of a clock signal therein. The multi-function driver also supports the second mode of operation in response to a second control signal by driving the bus with multi-bit data that is unrelated to the locked or unlocked status of the clock signal.

17 Claims, 20 Drawing Sheets

(From Fig. 3A)

(From Fig. 3A)

(From Fig. 7A)

(From Fig. 7A)

DISPLAY DRIVER CIRCUITS HAVING MULTI-FUNCTION SHARED BACK CHANNEL AND METHODS OF OPERATING SAME

REFERENCE TO PRIORITY APPLICATION

This application claims priority under 35 U.S.C §119 to Korean Patent Application No. 10-2011-0096478, filed Sep. 23, 2011, the disclosure of which is hereby incorporated herein by reference.

FIELD

The present invention relates to integrated circuit devices and methods of operating same and, more particularly, to integrated circuit display devices and methods of operating integrated circuit display devices.

BACKGROUND

Display devices, such as Liquid Crystal Display (LCD) devices and Plasma Display Panel (PDP) devices, may include a display driver IC (DDI) therein. A display device may include a plurality of source driver chips (i.e., source drivers) having a DDI configuration. Each source driver may include driver source lines (e.g., data lines) of a panel based on display data of a timing controller. As a backward signal line, a shared back channel (SBC) may be used as a dedicated bus for transferring a soft fail signal output from any of the source drivers to a timing controller. Herein, the soft fail signal may indicate an unlocking state of a clock recovery unit or whether setting values are changed due to Electro-Static Discharge (ESD). When a clock is locked, the soft fail signal may be set to a logical high level by a turn-off operation of a shared back channel driver within a source driver. When a clock is un-locked, the soft fail signal may be set to a logical low level by a turn-on operation of the shared back channel driver within the source driver. Examples of display driver ICs are disclosed in U.S. Pat. No. 7,259,742 to Chang et al. and U.S. Pat. No. 7,737,939 to Shin et al., the disclosures of which are hereby incorporated herein by reference.

SUMMARY

Display driver circuits according to embodiments of the invention include a first multi-function driver, which is configured to support at least first and second modes of operation. The first multi-function driver supports the first mode of operation in response to a first control signal by driving a bus with a first output signal. This first output signal has a value that indicates a locked or unlocked status of a first clock signal therein. The first multi-function driver also supports the second mode of operation in response to a second control signal by driving the bus with first data, which is unrelated to the locked or unlocked status of the first clock signal. This first data can be a multi-bit stream of data. A second multi-function driver may also be provided. This second multi-function driver is configured to support the first mode of operation in response to a third control signal by driving the bus with a second output signal having a value that indicates a locked or unlocked status of a second clock signal therein. The second multi-function driver is configured to support the second mode of operation in response to a fourth control signal by driving the bus with second data unrelated to the locked or unlocked status of the second clock signal. The first and second control signals may be provided as inactive and active states of a first read enable signal or vice versa and the third and fourth control signals may be provided as inactive and active states of a second read enable signal or vice versa.

According to some embodiments of the invention, the bus may operate as a shared back channel signal line and the first and second multi-function drivers may be configured to drive the shared back channel signal line with the first and second output signals, respectively, during the first mode of operation. Moreover, the first and second multi-function drivers may be electrically connected to the shared back channel signal line in a wired-OR configuration. In still further embodiments of the invention, the first multi-function driver may be configured to support the second mode of operation by driving the shared back channel signal line with a stream of data relating to at least one of touch sensor data, ambient light sensor data, temperature sensor data and bit error count data.

A timing controller may also be provided. This controller is configured to provide a first training clock to the first multi-function driver in response to receiving the first output signal having a value that indicates an unlocked status of the first clock signal. In particular, the timing controller may be configured to provide respective first and second training clocks to the first and second multi-function drivers during the first mode of operation in response to detecting a signal on the shared back channel signal line that reflects an unlocked status of any one of the first and second clock signals.

According to additional embodiments of the invention, a display driver circuit is provided with a plurality of drivers. These drivers have respective output terminals electrically coupled in common to a shared back channel signal line. The plurality of drivers are configured to respond to a first monitoring command provided in common thereto by informing the shared back channel signal line of the status of a signal or device therein. The plurality of drivers are further configured to individually respond to a read command provided one-at-a-time thereto by driving the shared back channel signal line with respective read data. The display driver circuit may also include a receiver, which is electrically connected to the shared back channel signal line, and a plurality of transmitters. The plurality of transmitters are configured to drive the plurality of drivers in parallel with the first monitoring command during a monitoring mode of operation in order to determine when respective clock signals within the plurality of drivers have all become locked. The timing controller may also be configured to provide a training clock to the plurality of drivers during the monitoring mode of operation.

A display driver circuit according to further embodiments of the invention may include a plurality of drivers having respective first terminals electrically connected in common to a shared back-channel signal line in a wire-OR configuration. The drivers are configured to support a clock training mode of operation by driving the shared back-channel signal line with a first signal that designates an unlocked status of at least one clock within said plurality of drivers. The drivers are also configured to support one-at-a-time data read modes of operation by driving the shared back-channel signal line with respective streams of data during non-overlapping time intervals. Each of these streams of data may include equivalent header and footer bit strings.

According to still further embodiments of the invention, a method of operating a display device includes providing a training clock to a first multi-function driver circuit in response to detecting an unlocked status of a first clock generated therein via a common bus connected to an output of the first multi-function driver circuit. The methods further include providing a first active read control signal to the first multi-function driver circuit in response to detecting a locked status of the first clock via the common bus. In response to the first active read control signal, the first multi-function driver transmits first read data to the common bus.

The methods further include providing a training clock to a second multi-function driver circuit in response to detecting an unlocked status of at least one of a second clock generated therein and the first clock via a common bus connected to an output of the second multi-function driver circuit. A second active read control signal may be provided to the second multi-function driver circuit in response to detecting a locked status of the first and second clocks via the common bus. Second read data may be transmitted from the second multi-function driver circuit to the common bus in response to the second active read control signal. The providing of the first active read control signal and the providing of the second active read control signal are only performed one-at-a-time. The providing of the training clock to the second multi-function driver circuit may also include providing first and second training clocks to the first and second multi-function driver circuits, respectively.

BRIEF DESCRIPTION OF THE DRAWINGS

The above and other objects and features will become apparent from the following description with reference to the following figures, wherein like reference numerals refer to like parts throughout the various figures unless otherwise specified.

DETAILED DESCRIPTION OF EMBODIMENTS

Figure 1A:
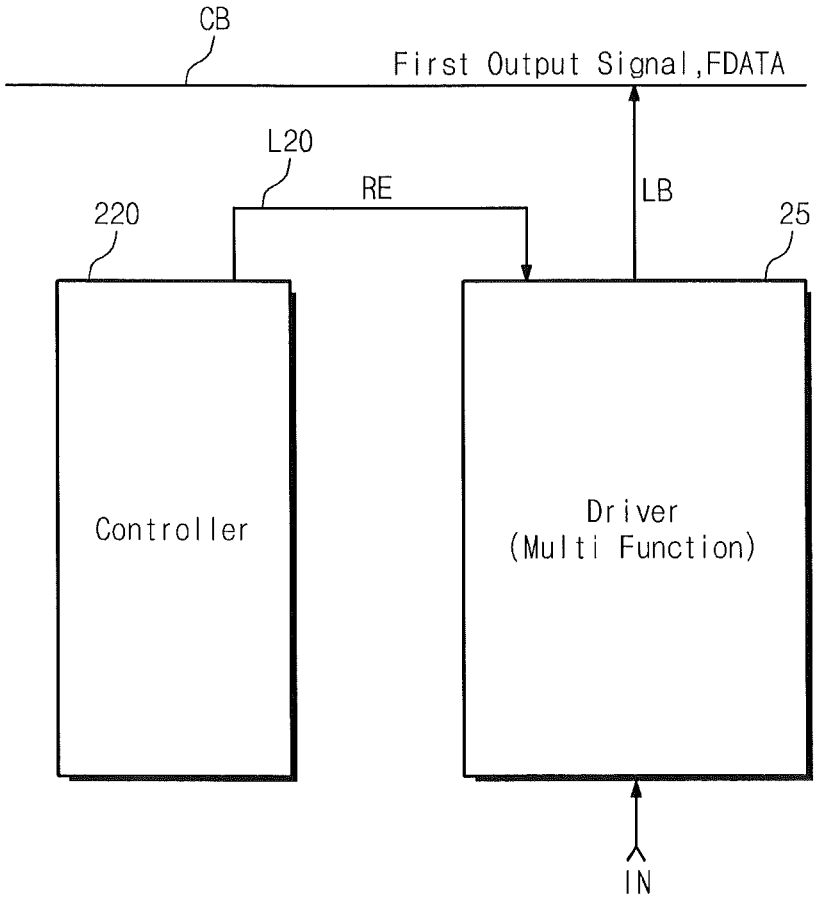
FIGS. 1A-1B are block diagrams of multi-function driver circuits according to embodiments of the inventive concept.

The inventive concept is described more fully hereinafter with reference to the accompanying drawings, in which embodiments of the inventive concept are shown. This inventive concept may, however, be embodied in many different forms and should not be construed as limited to the embodiments set forth herein. Rather, these embodiments are provided so that this disclosure will be thorough and complete, and will fully convey the scope of the inventive concept to those skilled in the art. In the drawings, the size and relative sizes of regions may be exaggerated for clarity. Like numbers refer to like elements throughout.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Figure 1B:
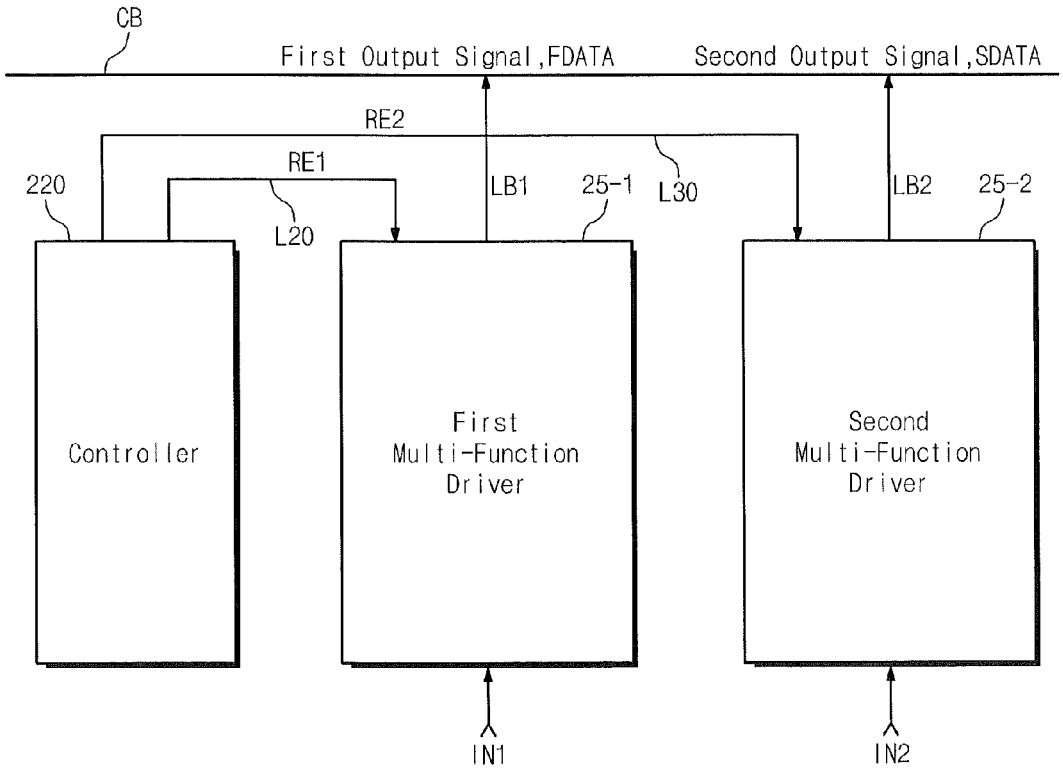

FIGS. 1A-1B are block diagrams of multi-function driver circuits according to embodiments of the inventive concept. Referring to FIG. 1A, a driver 25 may be controlled by a controller 220 and may be connected to a common bus CB. The driver 25 may have an input terminal IN. The driver 25 may have a first mode of operation or a second mode of operation according to a read enable signal RE applied via a line L20. The first mode of operation may be referred to as a monitoring or training mode, and the second mode of operation may be referred to as a data read mode. If the first mode of operation is executed in response to an inactive state of the read enable signal RE, a soft fail signal may appear on the common bus CB, which is capable of becoming a shared back channel, as a first output signal. This first output signal may have a logical high value or a logical low value. If the second mode of operation is executed in response to an active state of the read enable signal RE, read-out data output from various internal circuits may appear on the common bus as first data FDATA. For example, the first data FDATA may be a stream of data having a format established according to a clock. The driver 25, which drives the common bus CB, may have at least two modes of operation according to a state of the read enable signal RE. For this reason, the driver 25 may be referred to as a multi-function driver. In a case where one driver 25 is provided, a local bus LB may be the common bus CB. However, in the case where a plurality of drivers are provided, one common bus CB may be connected to a plurality of local buses LB. For example, as illustrated by FIG. 1B, drivers 25-1 and 25-1 may be controlled by a controller 220 and may be connected to a common bus CB. These drivers 25-1 and 25-2 may have respective input terminals IN1 and IN2. Each of these drivers 25-1, 25-2 may have a first mode of operation or a second mode of operation according to a read enable signal RE1 (or RE2) applied via a line L20 (or L30), as illustrated. The first mode of operation may be referred to as a monitoring or training mode, and the second mode of operation may be referred to as a data read mode. If the first, mode of operation is executed in response to an inactive state of the read enable signal RE, a soft fail signal may appear on the common bus CB, which is capable of becoming a shared back channel, as a first (or second) output signal. This first (or second) output signal may have a logical high value or a logical low value. If the second mode of operation is executed in response to an active state of the read enable signal RE, read-out data output from various internal circuits may appear on the common bus as first data FDATA (or second data SDATA), which may be a stream of data having a format established according to a clock.

Figure 2:
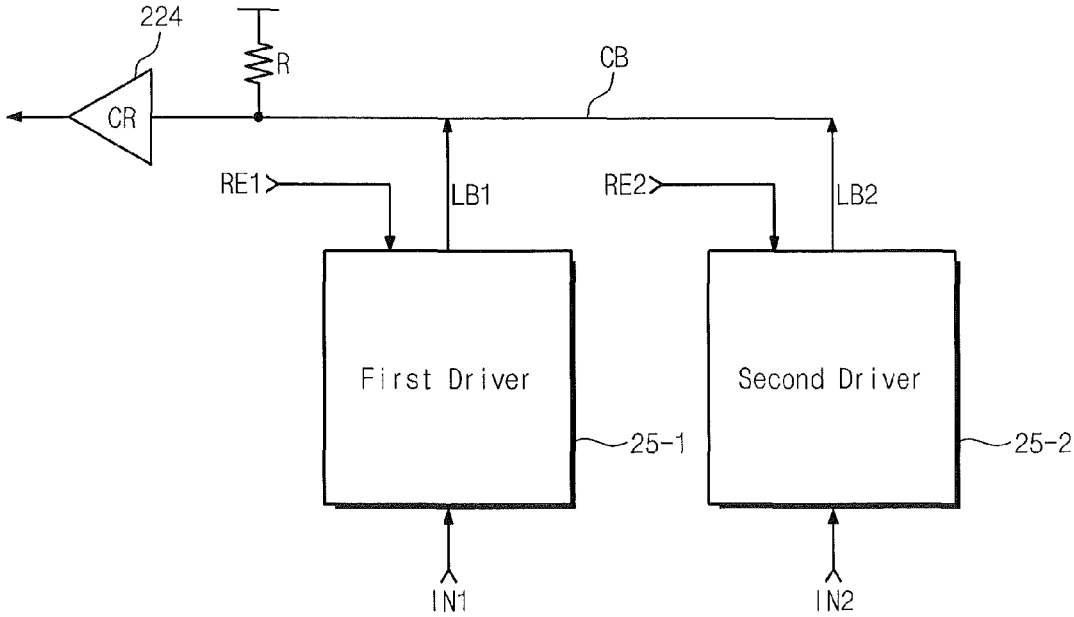
FIG. 2 is a block diagram illustrating a plurality of drivers electrically coupled to a common bus, according to an embodiment of the inventive concept.

FIG. 2 is a block diagram of drivers according to another embodiment of the inventive concept. Referring to FIG. 2, a first driver 25-1 may be connected to a common bus CB via a first local bus LB1, and a second driver 25-2 may be connected to the common bus CB via a second local bus LB2. A common receiver 224 may receive first read data from the first driver 25-1 or second read data from the second driver 25-2. This read data is transferred via the common bus CB, which may be held "weakly" at a logic 1 voltage level (e.g., Vdd) by a pull-up resistor R. As illustrated more fully hereinbelow, this resistor may be embodied as a PMOS pull-up transistor having gate and drain terminals shorted together. When a first read enable signal RE1 is set to an inactive state, a second read enable signal RE2 can be activated independently. In this case, second data output (i.e., second read data) from the second driver 25-2 may be transferred to the common receiver 224 via the common bus CB, which operates as a shared back channel. On the other hand, when the second read enable signal RE2 is at an inactive state, the first read enable signal RE1 can be activated independently. In this case, first data output (i.e., first read data) from the first driver 25-1 may be transferred to the common receiver 224 via the common bus CB. As described more fully hereinbelow, each driver may support two modes of operation, but may only be disposed one-at-a-time in an active read mode of operation with the common bus CB.

Figure 3A:
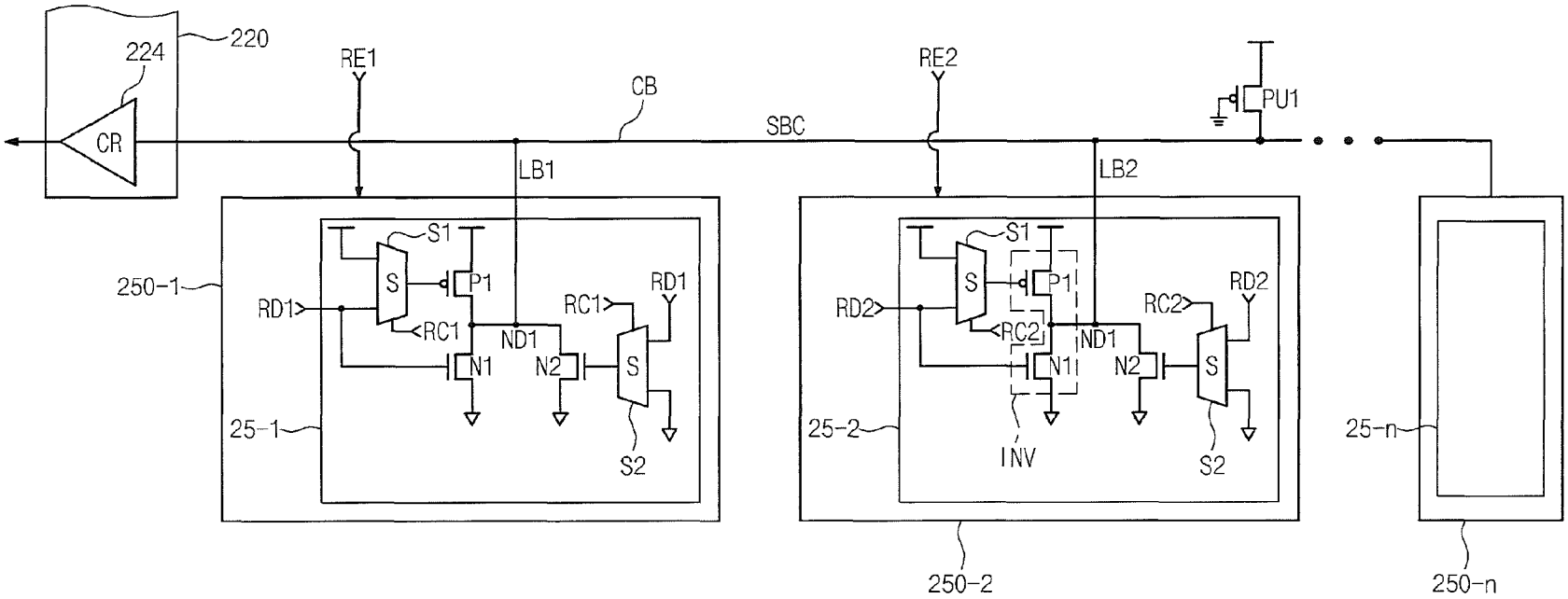
FIG. 3A is an electrical schematic illustrating a plurality of source drivers electrically coupled by a common bus to a timing control circuit, according to an embodiment of the present invention.

FIG. 3A is a circuit diagram of a plurality of source drivers 250-1, 250-2, . . . , **250-*n*, which includes a corresponding plurality of driver circuits 25-1 and 25-2 as shown by FIG. 2. As described more fully hereinbelow, the driver circuits 25-1 and 25-2 may have two modes of operation and may be controlled by the timing controller 220. Referring to FIG. 3A, a first driver circuit 25-1 may include three MOS transistors and two selectors (e.g., multiplexers). The first driver circuit 25-1 for data transmission may include a first MOS transistor N1 having a drain connected to the common bus CB via node ND1, a source that is grounded and a gate connected to receive a first input signal RD1. A second MOS transistor N2 is also provided, which has a drain connected to the common bus CB via node ND1 and a source that is grounded. A third PMOS transistor P1 is provided, which has a drain connected to the common bus CB via node ND1 and a source connected to a power supply voltage (e.g., Vdd). A first selector/multiplexer S1 is provided, which selects one of the first input and a second input according to a state of a read control signal RC1. The first selector S1 has an output connected to a gate terminal of the third PMOS transistor P1. This read control signal RC1 may correspond to the externally-applied read enable signal RE1, which may be provided by the timing controller 220. A second selector/multiplexer S2 is provided, which selects one of a third input and a fourth input according to a state of the read control signal RC1. This second selector S2 has an output connected to a gate of the second MOS transistor N2**.

In FIG. 3A, the first input to the first selector S1 and the third input to the second selector S2 may be the same signal (i.e., both may be signal RD1). This same signal RD1 can be treated as a soft fail signal (that designates the locked or unlocked status of an internal clock) or as read-out data signal, depending on the mode of operation. The first and second MOS transistors N1 and N2 may be n-channel MOS field effect transistors and the third MOS transistor P1 may be a p-channel MOS field effect transistor. However, the inventive concept is not limited thereto and these transistor types may be changed accordingly. Moreover, in the event the second input to the first selector 51 is fixed to a first logic state (e.g., logic 1=Vdd), the fourth input to the second selector S2 may be fixed to a second logic state (e.g., logic 0=Gnd), however, alternative fixed states may be used according to additional embodiments of the invention. The second driver circuit 25-2 and all other driver circuits may have the same configuration as the first driver circuit 25-1, as illustrated.

Operation of the multi-function driver circuit of FIG. 3A will now be described. Each of the read control signals RC1 and RC2 provided to the select terminals of the selectors/multiplexers S1, S2 in the first and second drivers 25-1, 25-2, respectively, may be inactivated during a monitoring mode of operation and may be independently activated one-at-a-time during a data read mode of operation. If the read control signal RC1 is inactivated during the monitoring mode, the first selector S1 within the first driver circuit 25-1 may select the second input and thereby pass a high state signal (e.g., Vdd) to the gate of the third MOS transistor P1 to thereby maintain the third MOS transistor P1 in an "off" state. In addition, the second selector S2 within the first driver circuit 25-1 may select the third input and thereby pass a soft fail signal input to the gate of the second MOS transistor N2. As a result, when the input signal RD1 is logically low during the monitoring mode of operation, the first and second MOS transistors N1 and N2 may be turned off along with the third MOS transistor P1, which enables the node ND1 (and common bus CB) to be held "weakly" at a pre-charged voltage level by an always-on PMOS pull-up transistor PU1 having a relatively high resistance (or another type of resistor R).

Thus, in the event a clock of a clock recovery unit within the first source driver 250-1 is locked (i.e., properly synchronized), the input signal RD1 may have a logical low level, which means that first data having a logical high state is maintained at a precharged level on the common bus CB. On the other hand, when the input signal RD1 is logically high, the first and second MOS transistors N1 and N2 will be turned on. In this case, a potential of the node ND1 will be pulled-down (i.e., discharged) to a ground voltage level (e.g., Gnd), which means that first data having a logical low state appears at the common bus CB. As described more fully hereinbelow, in the event a clock of a clock recovery unit is unlocked (e.g., out-of-sync), the corresponding input signal RD1 may have a logical high level, which means that the first data having the logical low state is transferred to the common bus CB to thereby reflect the unlocked status of the clock within the first source driver 250-1. Moreover, if the first data of a logical low state is provided onto the shared back channel during the monitoring mode, a timing controller 220 having the common receiver 224 therein may recognize the clock as being unlocked, and may provide (or continued to provide) a training clock to a corresponding source driver. Thus, during the first mode of operation, a locking state signal indicating a locked/unlocked state of a clock recovery unit within a source driver may be transmitted via the common bus CB.

In contrast, if the read control signal RC1 is activated during a data read mode of operation (i.e., the second mode of operation), the first selector S1 may select the first input (i.e., signal RD1) and output it to the gate of the third MOS transistor P1. The third MOS transistor P1 may be turned on or off according to a logic state of the first input RD1. The first and third MOS transistors N1 and P1 may constitute a CMOS inverter INV. The second selector S2 may also select the fourth input (e.g., a logical low level) and output it to the gate of the second MOS transistor N2. Accordingly, the second MOS transistor N2 may be turned off. Accordingly, when the input signal RD1 is logically low, the first MOS transistor N1 may be turned off, while the third MOS transistor P1 may be turned on. This may mean that the node ND1 is driven to a power supply voltage (e.g., Vdd) by the PMOS transistor P1, which means that second data having a logical high state may appear on the common bus CB. But, when the input signal RD1 is logically high, the first MOS transistor N1 may be turned on, while the third MOS transistor P1 may be turned off. This will cause the node ND1 to be pulled down to a logic 0 voltage level (e.g., Gnd) because the pull-down strength of the first MOS transistor N1 is greater than the pull-up strength of the PMOS pull-up transistor PU1. Thus, during the data read mode of operation, the common receiver 224 within the timing controller 220 may receive the second data as an inverted version of the first input RD1 of the selected driver (e.g., 25-1, 25-2, . . . , **25-*n***), via the common bus (i.e., shared back channel SBC). This second data may be bit error rate (BER) test data, panel touch data, brightness data, temperature data or other data stored within the corresponding source driver.

Moreover, to achieve a smooth transition from the second mode of operation (e.g., data read mode) to the first mode of operation (e.g., monitoring/training mode), the pull-down driving capacity of the second MOS transistor N2 within an unselected driver **25-*n* receiving an inactive read control signal RCn (i.e., inactive read enable signal REn) should be greater than the combined (i.e., parallel) pull-up strengths of the common PMOS pull-up transistor PU1 and the PMOS pull-up transistor P1 within a selected driver providing read data to the common bus CB in response to an active read control signal. Thus, as described more full hereinbelow with respect to the timing diagram of FIG. 3E, even if the PMOS pull-up transistor P1 is driving the common bus CB with a logic 1 data value, an unselected driver 25-*n* having an unlocked clock therein will override the logic 1 data value by pulling the common bus CB to a logic 0 voltage level and holding the common bus CB at the logic 0 voltage level until a new training clock operation is performed to lock the clock within the unselected driver 25-*n***.

Figure 3B:
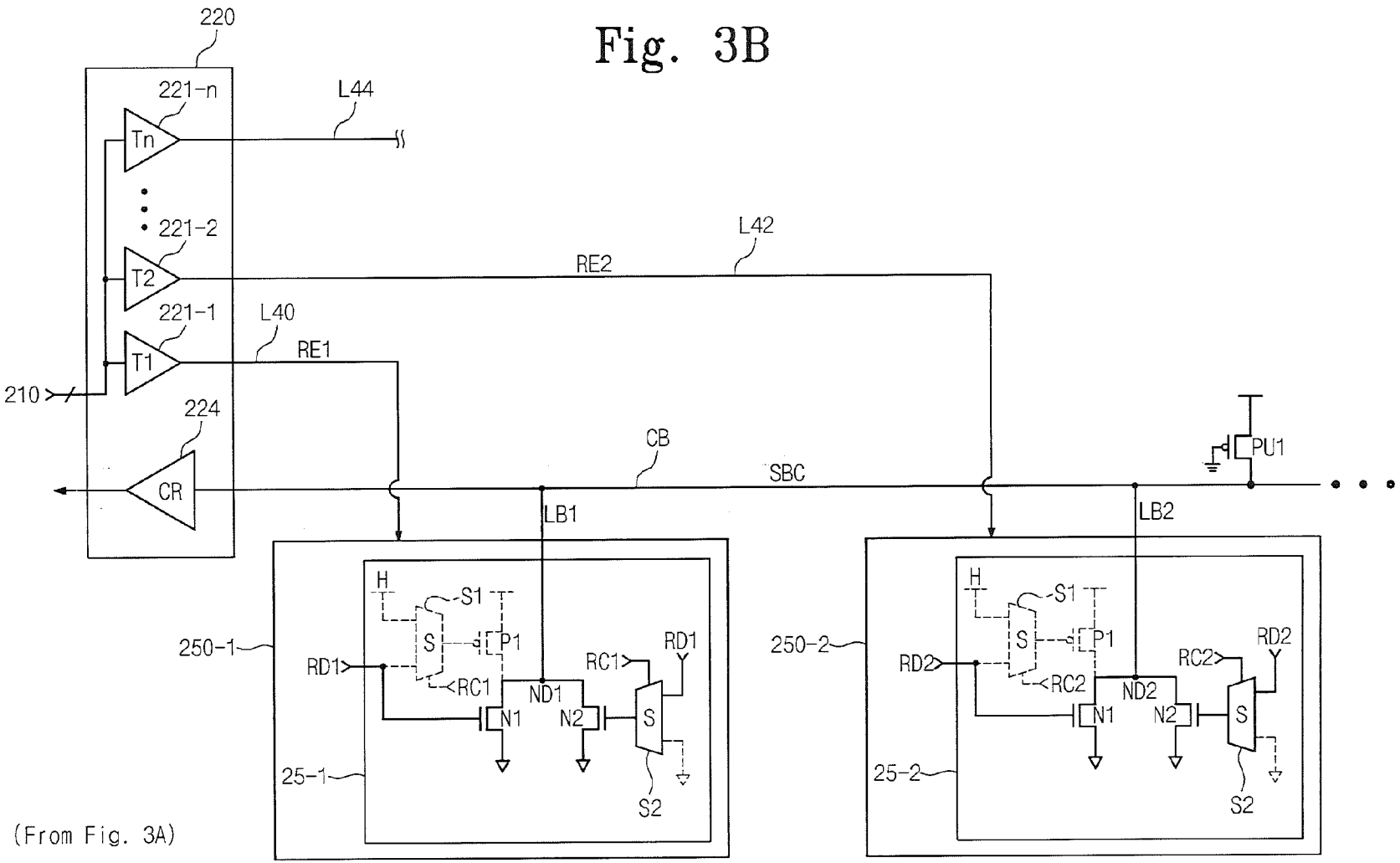
FIG. 3B is an electrical schematic of the plurality of source drivers of FIG. 3A, with selective components removed to highlight operation of the source drivers during a monitoring mode of operation.

FIG. 3B illustrates components of a display driver circuit according to additional embodiments of the invention during a first monitoring mode of operation when each of the source drivers 250-1, 250-2, . . . , **250-*n* is receiving a respective training clock. These training clocks support synchronization of clock signals within the source drivers 250-1, 250-2, . . . , 250-*n*. In contrast to the embodiment of FIG. 3A, the timing controller 220 of FIG. 3B is illustrated as including a common receiver 224 having an input terminal electrically coupled to the common bus (CB), which operates as a shared back-channel SBC, and a plurality of transmitters 221-1, 221-2, . . . , 221-*n*. These transmitters have input terminals electrically coupled to an input bus 210 and output terminals connected to respective signal lines L40, L42, . . . , L44, which provide respective read enable signals RE1, RE2, . . . , REn to the source drivers 250-1, 250-2, . . . , 250-*n*. As shown by FIG. 3B, elements of the drivers 25-1, 25-2, . . . , 25-*n* of FIG. 3A which are inactive in response to inactive read enable signals (i.e., RC1, RC2, . . . , RCn=0) have been omitted from view. Each of the input signals RD1, RD2, . . . , RDn is provided to a respective pair of NMOS pull-down transistors N1, N2, which means the common bus CB will be pulled low from a "weakly" precharged logic 1 voltage level whenever one (or more) of the input signals RD1, RD2, . . . , RDn is set to a logic 1 value to reflect the unlocked status of a clock within a corresponding source driver 250-1, 250-2, . . . , 250-*n*. The maintenance of a sustained logic 0 voltage level on the common bus CB during the monitoring mode of operation (i.e., when RE1, RE2, . . . , REn=0) will result in a sustained generation of a training clock to each of the source drivers until the common bus CB is returned to a logic 1 voltage level. This return to a logic 1 voltage level will occur when all input signals RD1, RD2, . . . , RDn are switched to logic 0 voltage levels to thereby turn off the NMOS pull-down transistors N1, N2 within each of the drivers 25-1, 25-2, . . . , 25-*n* and demonstrate that all the corresponding clocks within the source drivers (250-1, 250-2, . . . , 250-*n***) have been sufficiently trained (i.e., synchronized).

Figure 3C:
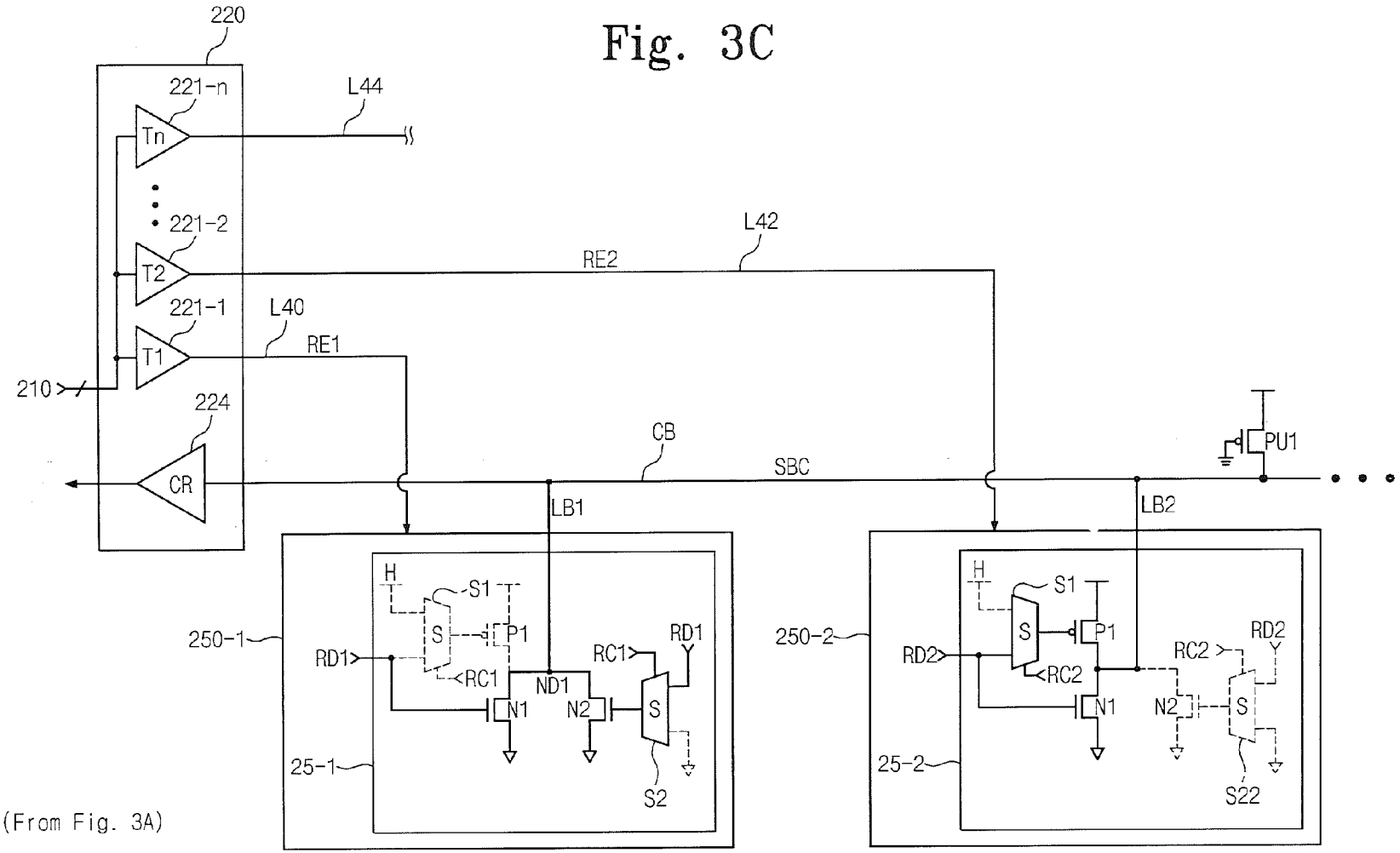
FIG. 3C is an electrical schematic of the plurality of source drivers of FIG. 3A, with selective components removed to highlight operation of one of the source drivers during a data read mode of operation.

FIG. 3C illustrates how the clock training operation described with respect to FIG. 3B can be followed by an operation to read data (e.g., bit error rate (BER) test data, panel touch data, brightness data, temperature data, etc.) from the second driver 25-2 within the second source driver 250-2 concurrently with monitoring a status of a clock within the first source driver 250-1 (and other source drivers). These modes of operation can be achieved by driving the first source driver 250-1 with an inactive read enable signal RE1, which may be translated as an inactive read control signal RC1 within the first source driver 250-1, while concurrently driving the second source driver 250-2 with an active read enable signal RE1, which may be translated as an active read control signal RC2 within the second source driver 250-2. This active read control signal RC2 will enable operation of an inverter (i.e., the PMOS pull-up transistor P1 and NMOS pull-down transistor N1) because the active read control signal RC2 will support the passing of the input signal RD2 through the selector/multiplexer S1 to the gate terminal of the PMOS transistor P1 (while simultaneously maintaining an NMOS pull-down transistor N2 in an off state by passing a logic 0 voltage signal (e.g., Gnd) through the selector/multiplexer S2 (not shown in FIG. 3C)). Accordingly, so long as the input signal RD1 within the first source driver 250-1 is maintained at a logic 0 voltage level to thereby reflect continuous synchronization of a clock therein, the input terminal of the common receiver 224 within the timing controller 220 will be driven with read data from the second source driver 250-2 (e.g., CB=/RD2).

Figure 3D:
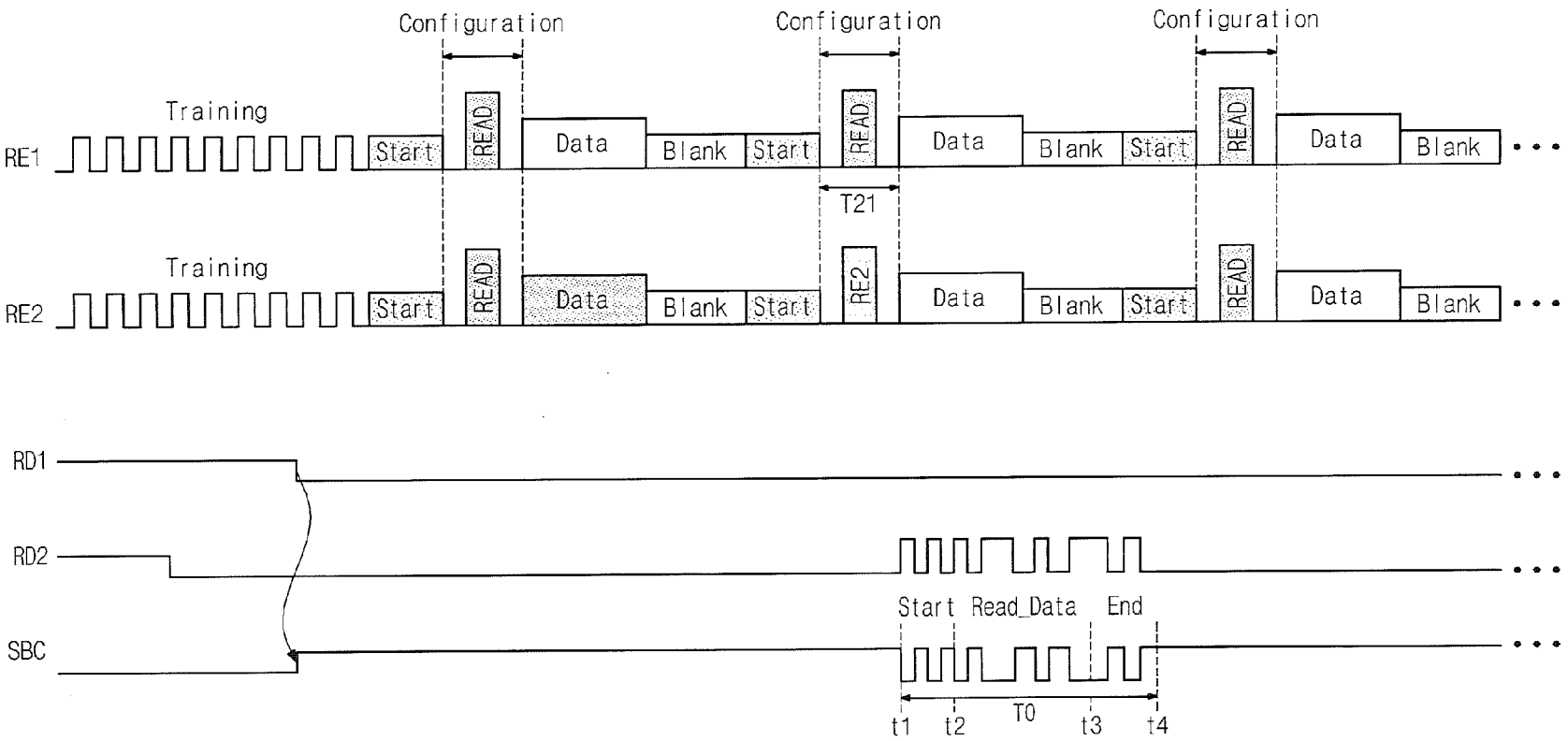
FIG. 3D is a timing diagram that illustrates timing of signals RD1, RD2 and SBC from FIG. 3C during an operation to train a plurality of source drivers followed by an operation to read data from a second source driver.
Figure 3E:
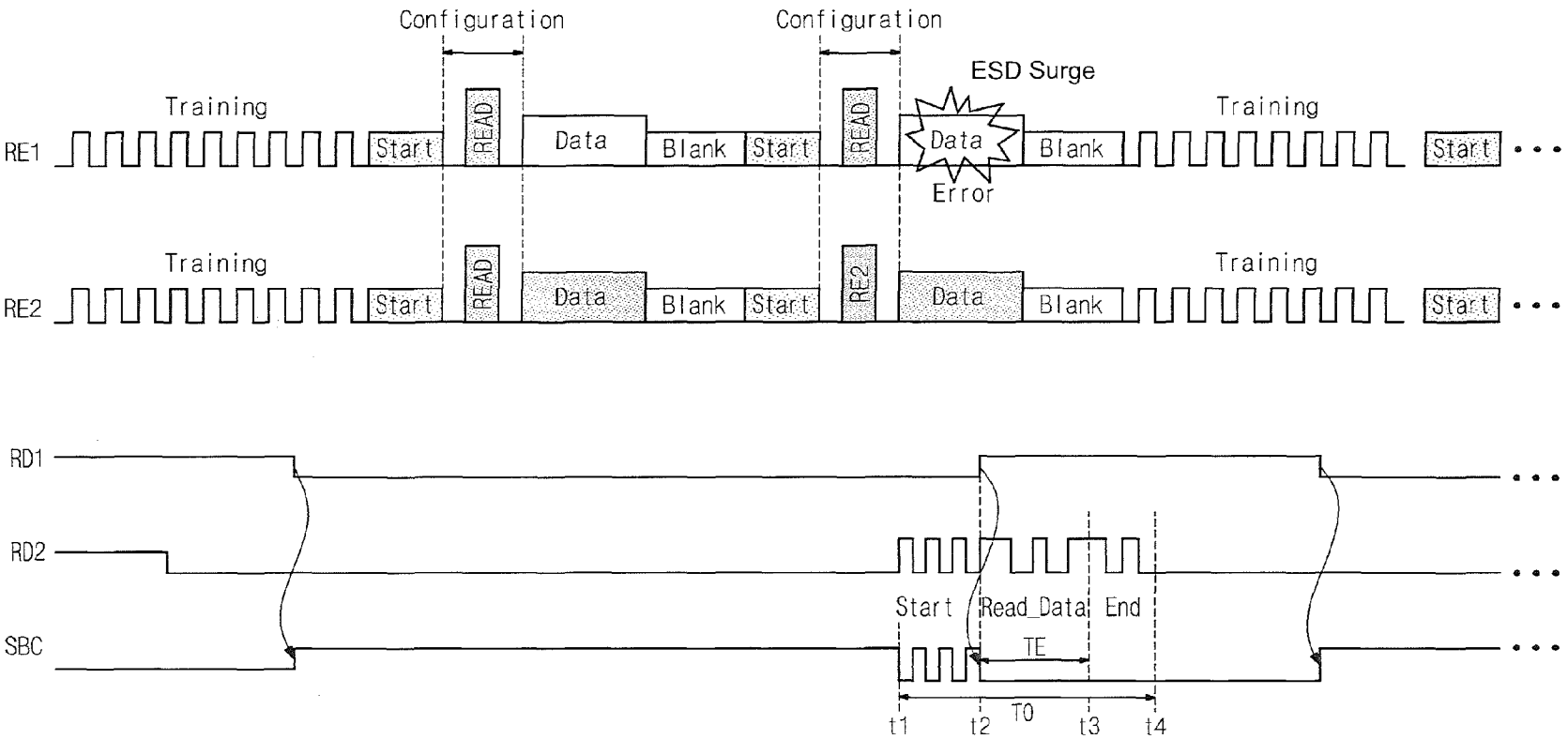
FIG. 3E is a timing diagram that illustrates timing of signals RD1, RD2 and SBC from FIG. 3C during an operation to train a plurality of source drivers followed by an operation to read data from a second source driver during an ESD surge event.

FIGS. 3D-3E are timing diagrams that illustrate the timing of the operations described above with respect to FIG. 3C, during which read data (/RD2) is provided from the second source driver 250-2 to the shared back channel SBC (i.e., the common bus CB) in response to an active read enable signal RE2. As shown by FIG. 3D, the source drivers 250-1, 250-2, . . . , **250-*n* are responsive to respective training clocks during a monitoring mode of operation when the read enable signals RE1, RE2, . . . , REn are held at logic 0 voltage levels (i.e., inactive). In response to these training clocks, internal clock signals (e.g., PLL clock signals) within the source drivers are synchronized. Once the last of the internal clock signals is synchronized, the shared back channel SBC switches from a logic 0 voltage level to a logic 1 voltage level by virtue of the pull-up strength of the PMOS pull-up transistor PU1 and the fact that all input signals RD1, RD2, . . . , RDn have been set to logic 0 voltage levels to thereby turn off the NMOS pull-down transistors N1, N2 within the drivers 25-1, 25-2, . . . , 25-*n*. Thereafter, upon activation of the read enable signal RE2 during time interval T21, a data read operation from the second driver 25-2 commences during the time interval T0 (i.e., from time point t1 to time point t4). During this data read operation, header information (start), data (Read_Data) and footer information (end) is provided onto the shared back channel SBC at time points t1, t2 and t3, respectively. The header and footer information is provided as a relatively short alternating sequence of logic 1 and logic 0 data bits in order to enable the timing controller 220 to confirm commencement and termination of a valid data read interval (T0) associated with the active read enable signal RE2. However, as shown by the 0-to-1 transition of the signal RD1 during time interval T0 in FIG. 3E, if an erroneous event (e.g, ESD surge) occurs, which results in any clock within the source drivers 250-1, 250-2, . . . , 250-*n* becoming out-of-sync, the sustained logic 0 value on the shared back channel SBC during the time interval T0 will be properly interpreted as invalid data by the timing controller 220 (e.g., by virtue of the missing footer containing alternating logic 1 and logic 0 data bits). In response to the missing footer during the time interval from time point t3 to time point t4, the timing controller 220 will reinstate a monitoring mode of operation during which a previously enabled read enable signal is inactivated (i.e., RE1, RE2, . . . , REn=0). During this monitoring mode of operation, respective training clocks are once again provided to the source drivers 250-1, 250-2, . . . , 250-*n*** until all clocks are resynchronized and the shared back channel SBC is again reset to a logic 1 voltage level.

Figure 4:
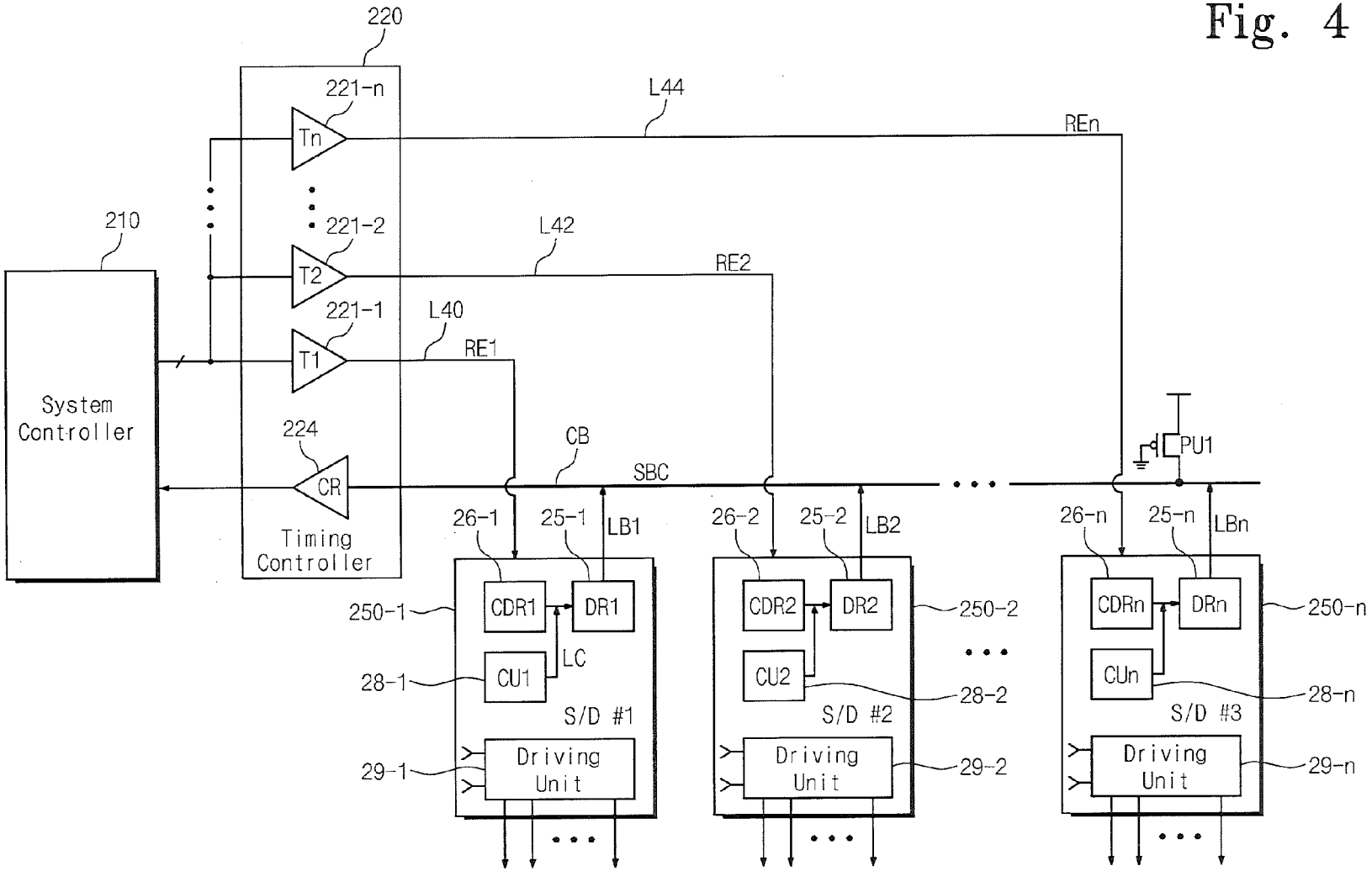
FIG. 4 is a block diagram schematically illustrating a plurality of source drivers and a timing controller according to an embodiment of the inventive concept.

FIG. 4 is a block diagram schematically illustrating a source driver and a timing controller according to an embodiment of the inventive concept. Referring to FIG. 4, a timing controller 220 may include a plurality of transmitters 221-1 through **221-*n* and a common receiver 224. The timing controller 220 may be connected to a system controller 210. The plurality of source drivers 250-1 through 250-*n* may be connected to the plurality of transmitters 221-1 through 221-*n* within the timing controller 220. An interface for transmitting display data from the timing controller 220 to the source drivers 250-1 through 250-*n*** may be called an intra-panel interface. The intra-panel interface may use a Reduced Swing Differential Signaling (RSDS) interface, which adopts a multi-drop manner, or a Point-to-Point Differential Signaling (PPDS) interface, which adopts a point-to-point manner.

The source driver 250-1 may include a shared back channel driver circuit 25-1, a clock recovery unit 26-1, an internal circuit 28-1, and a display panel driving unit 29-1. As a circuit recovering a clock, the clock recovery unit 26-1 may include a DLL or PLL circuit and may output a soft fail signal indicating whether a clock therein is unlocked or locked. The internal circuit 28-1 may be a circuit for outputting read-out data via a line LC, and may include the circuit or circuits illustrated in FIG. 11. This may mean that bit error rate test data, panel touch data, brightness data, or temperature data etc. can be driven by the shared back channel driver circuit 25-1 so as to be transmitted to the common bus CB. The driving unit 29-1 may be a circuit for driving source lines of a panel, and may be controlled by the timing controller 220.

The common bus CB, which operates as a back channel signal line, may provide a soft fail signal to the timing controller 220 during a first mode of operation. For example, in a case where a clock recovery unit is unlocked or setting values are changed by Electro-Static Discharge (ESD), the source drivers 250-1 through **250-*n* may set common bus CB to a logical low state. The common bus CB may be a shared back channel SBC, which is shared by the source drivers 250-1 through 250-*n*. In FIG. 4, there is illustrated an embodiment that the timing controller 220 and the source drivers 250-1 through 250-*n* are connected in a multi-drop manner. However, the inventive concept is not limited thereto. For example, the shared back channel SBC can be connected between the timing controller 220 and the source drivers 250-1 through 250-*n*** in a daisy chain manner. The shared back channel SBC may utilize an Enhanced Reduced Voltage Differential Signaling (eRVDS) method to achieve a smooth signal interface.

Figure 5:
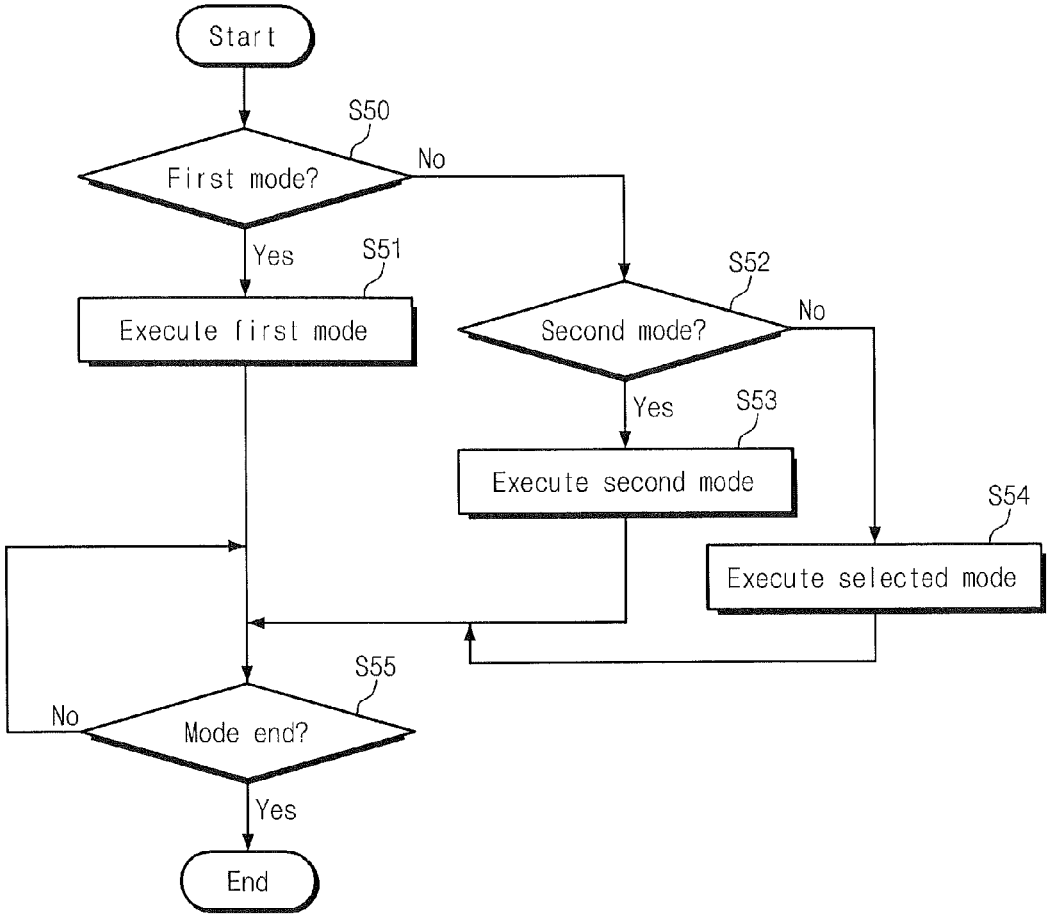
FIG. 5 is a flowchart that illustrates multiple modes of operating the source drivers and timing controller of FIG. 4, according to an embodiment of the invention.

FIG. 5 is a flowchart for describing a data transmission operation according to an embodiment of the inventive concept. During operation S50, a check is made to determine whether or not a first mode of operation is desired. If it is, operation S51 is performed to execute the first mode of operation. Referring to the second source driver 250-2 in FIG. 4, during the first mode of operation, a second read enable signal RE2, which is applied via a second transmitter 221-2, may be applied to the source driver 250-2 via a line L42. This second read enable signal RE2 may be set to an inactive state. Accordingly, as described hereinabove, if the second read control signal RC2, which is the same signal as the second read enable signal RE2, is inactivated, a third MOS transistor P1 within a driver circuit 25-2 may be turned off. Moreover, in the event a clock of a clock recovery unit 26-2 is locked, the input signal RD2 may be set to a logical low level, which means that first data having a logical high state may appear at the common bus CB. However, if the clock within the clock recovery unit 26-2 is unlocked, first data having a logical low state may appear at the common bus CB. If the first data having a logical low state is received via a shared back channel SBC during the first mode of operation (e.g., a monitoring mode), the timing controller 220 with the common receiver 224 therein may determine a clock to be unlocked within at least one source driver.

Referring again to FIG. 5, if the operation S50 determines that the first mode is not desired, the method proceeds to operation S52. During operation S52, a check is made to determine whether or not a second mode of operation has been selected. If it is, then an operation is performed at S53 to execute the second mode. Referring again to the source driver 250-2 in FIG. 4, the second read enable signal RE2 generated by the second transmitter 221-2 may be applied to the source driver 250-2 via the line L42. Accordingly, as described above in relation to FIGS. 3A-3E, if the second read control signal RC2, which is the same signal as the second read enable signal RE2, is activated, a first selector S1 within the driver circuit 25-2 may select the first input RD2 and output it to a gate of a third MOS transistor P1. Thus, the signal RD2 may be inverted by the CMOS inverter defined by the first and third MOS transistors N1 and P1. A second MOS transistor N2, which is turned off, may not participate in an operation during the second mode of operation. Based on this activation of the second driver 25-2, the second data having a logical high (low) state will appear on the common bus CB when the input signal RD2 is logically low (high).

During this second mode of operation, the timing controller 220 may receive the second data as an inverted version of the first input RD2 via the shared back channel SBC. The second data may be bit error rate test data, panel touch data, brightness data, color data, or temperature data, for example. When drivers 25-1, 25-3, . . . , **25-*n* are operating in the first mode of operation, a second driver 25-2 may be independently operating in the second mode of operation to transmit the second data having an established format via the common bus CB. The data with the established format may include start data indicating a start of data transmission (i.e., a packet header), read-out data being data to be transmitted and end data indicating an end of data transmission (i.e., a packet footer). In the event the decision at operation S52 of FIG. 5 indicates that the second mode of operation is not active, operation S54 may be performed to thereby execute another mode of operation rather than the first or second modes of operation. Finally, as shown by operation S55 in FIG. 5**, a check may be performed to end operations once the previously selected mode of operation has been completed.

Figure 6:
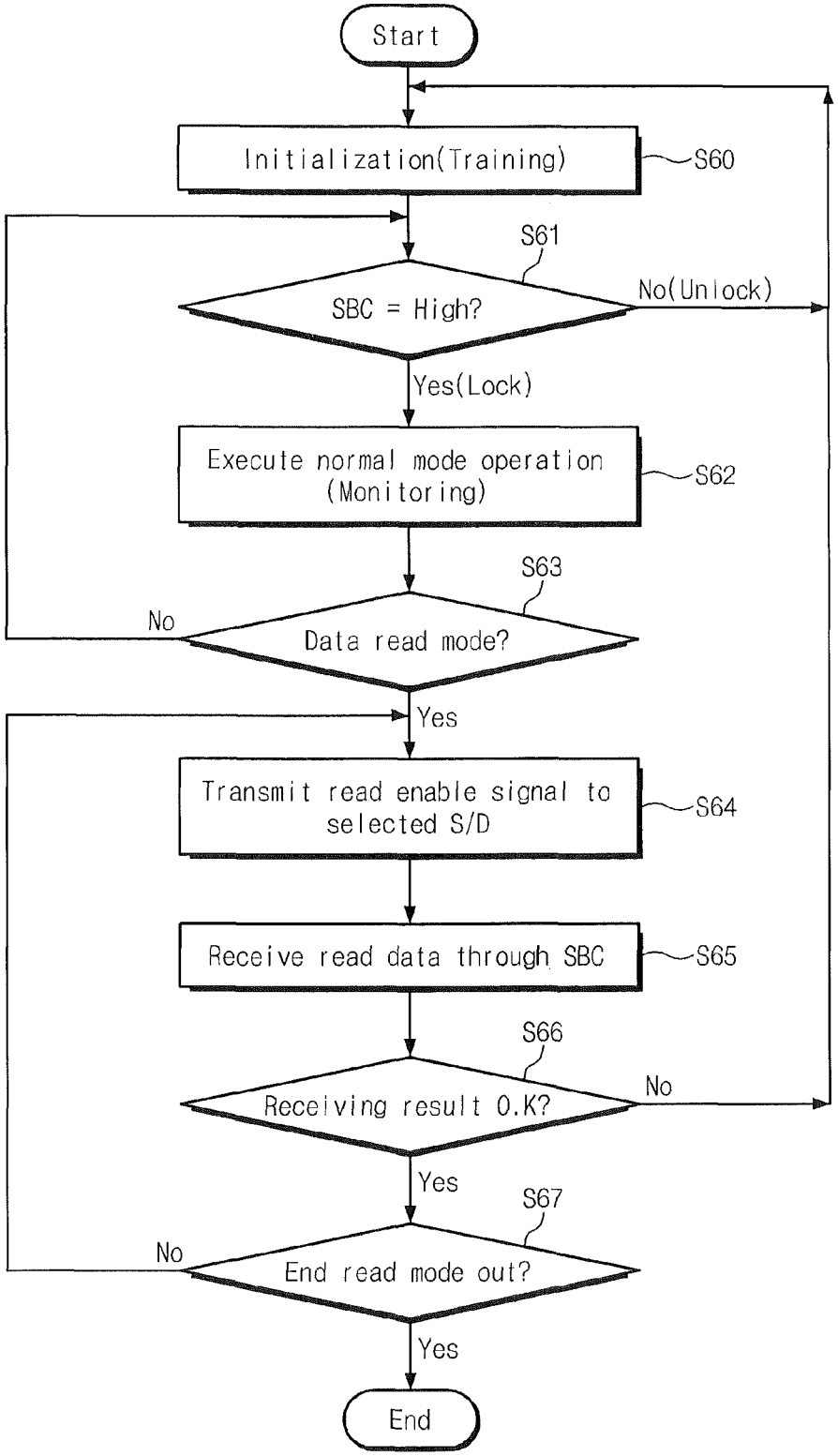
FIG. 6 is a detailed flowchart that illustrates multiple modes of operating the source drivers and timing controller of FIG. 4, according to an embodiment of the invention.
Figure 9:
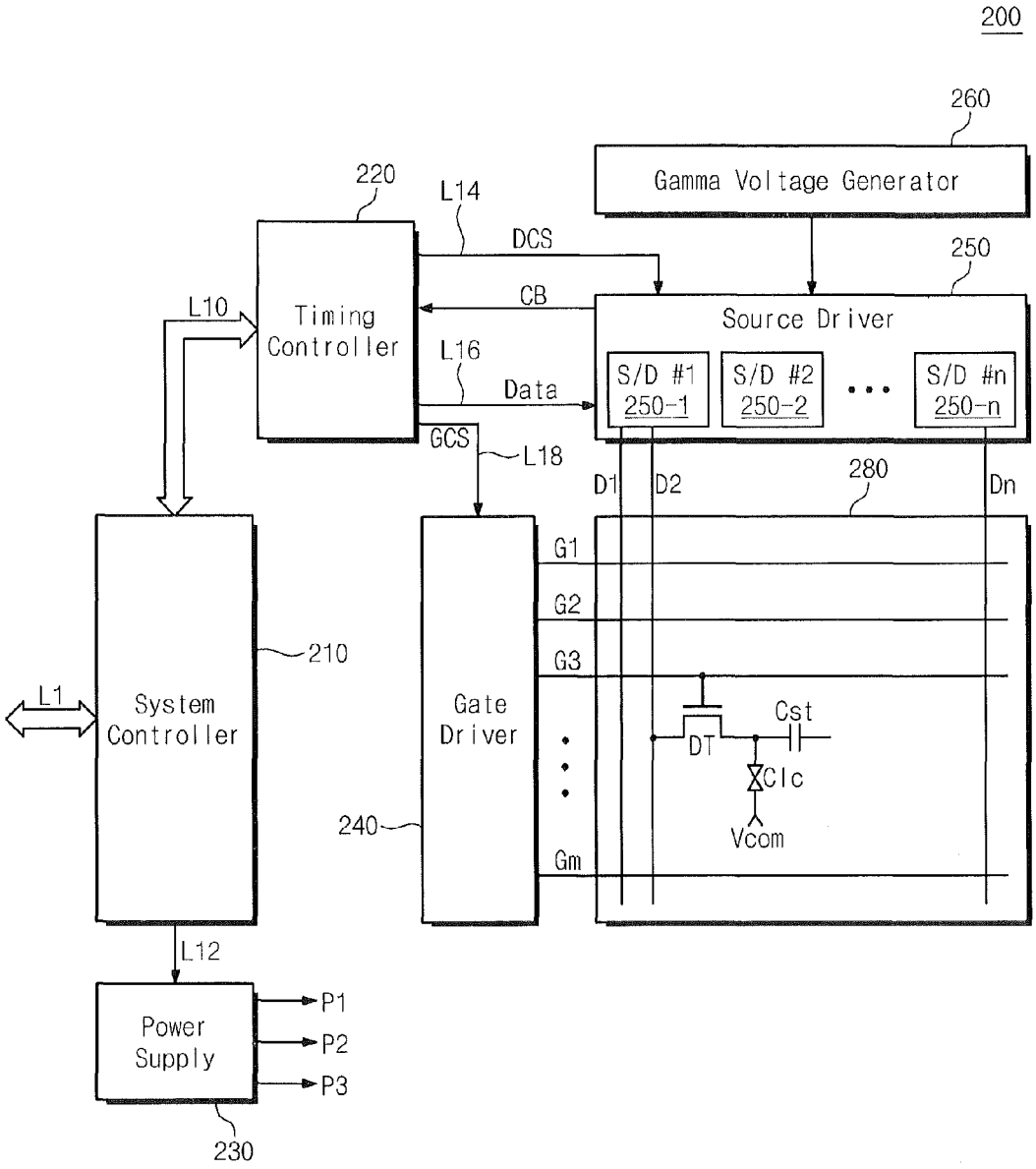
FIG. 9 is a block diagram schematically illustrating a display device according to an embodiment of the inventive concept.

FIG. 6 is a more detailed flowchart, which is related to the flowchart of FIG. 5. In FIG. 6, a monitoring mode of operation is a primary mode of operation until a data read mode is to be executed periodically. During this data read mode, an operation may be performed to cope with an error generation when data is transmitted via a shared back channel. As shown by Block S60 in FIG. 6, an initialization (training) operation may be executed, during which training signals may be provided to the source drivers 250-1, 250-2, . . . , **250-*n*. The training signals may be training clocks applied for a clock locking operation of a respective clock recovery unit. In particular, a clock recovery unit 26-1, 26-2, . . . , 26-*n* may perform an operation to lock an internal clock to the corresponding training clock to thereby enable synchronization of data within the corresponding source driver. In the situation where a clock is locked, a source driver may normally drive source lines of a display panel 280 according to input display data, as shown by FIG. 9**.

As shown by operation S61 in FIG. 6, a check is made to determine whether the first data on the shared back channel SBC is at a logical low state or a logical high state. If the first data on the shared back channel SBC is judged to be at a logical low state, a clock may be judged to be unlocked, which means that training operations need to be continued (see, e.g., Block S60). However, if the first data of the shared back channel SBC is judged to be at a logical high state, all clocks within the source drivers may be judged to be locked and a monitoring mode is continued as the primary mode of operation (see, e.g., Block S62). During this normal mode of operation, the source drivers 250-1, 250-2, . . . , **250-*n* may drive source lines of the display panel 280 and the timing controller 220** may continue to monitor whether all clocks remain locked, via the shared back channel SBC.

In addition, in the event the system controller 210 in FIG. 4 receives a read request associated with internal data of a panel via an external test device (or that internal data associated with a panel is needed within the system controller 210 itself), the operation S63 of FIG. 6 may be performed to confirm that a data read mode has been requested. If a data read mode has been requested, operations proceed to operation S64. Operation S64 may include applying an active read control signal to the selected source driver 250-2, which means a first input RD2 of the second driver 25-2 of may be data read out from an internal circuit 28-2 of FIG. 4, while a first input RD1 of the first driver 25-1 may be a locking signal output from a clock recovery unit 26-1.

Accordingly, as described above with respect to FIG. 3D, the first input RD2 of the second driver 25-2 may appear as data having an established format, which includes start data (indicating a start of data transmission), read-out data being data to be transmitted and end data (indicating an end of data transmission). This second data may have an inverted version of data applied as the first data RD2, due to an inverter function within the second driver 25-2. As a result, during the second mode of operation, second data read out from the internal circuit 28-2 may be transmitted via the shared back channel SBC in operation S65, and a common receiver 224 may receive the second data. In operation S66, the timing controller 220 may check whether data input via the common receiver 224 is erroneous. The receipt of erroneous data can be detected because the transmitted second data packet has an established format (i.e., header, data, footer). If the data input via the common receiver 224 is judged to be erroneous, data transmission must again be executed, and such a situation must be recognized by the timing controller 220. The data transfer error may be generated when the second source driver 250-2 transfers the second data via the shared back channel SBC and an unlocking state of a clock is generated within the first source driver 250-1. As shown in FIG. 3E, if a high input is generated within waveform RD1 during a transfer of the second data, an abnormal waveform SBC may appear at the shared back channel SBC even though the first input RD2 of the second driver 25-2 is valid data. As a result, the timing controller 220 may not receive an accurate end data signature (i.e., alternating 0-1 footer sequence). In response, the timing controller 220 may recognize a transfer error of the second data during the period T0. If an error in data transfer is detected in operation S66, the method returns to operation S60, but if an error in data transfer is not detected, the method moves on to operation S67. In operation S67 of FIG. 6, there may be judged whether execution of the data read mode has ended. If the data read mode has not ended, the method returns to operation S64. However, if the data read mode has ended, a monitoring mode being the first mode of operation may be executed.

Figure 7A:
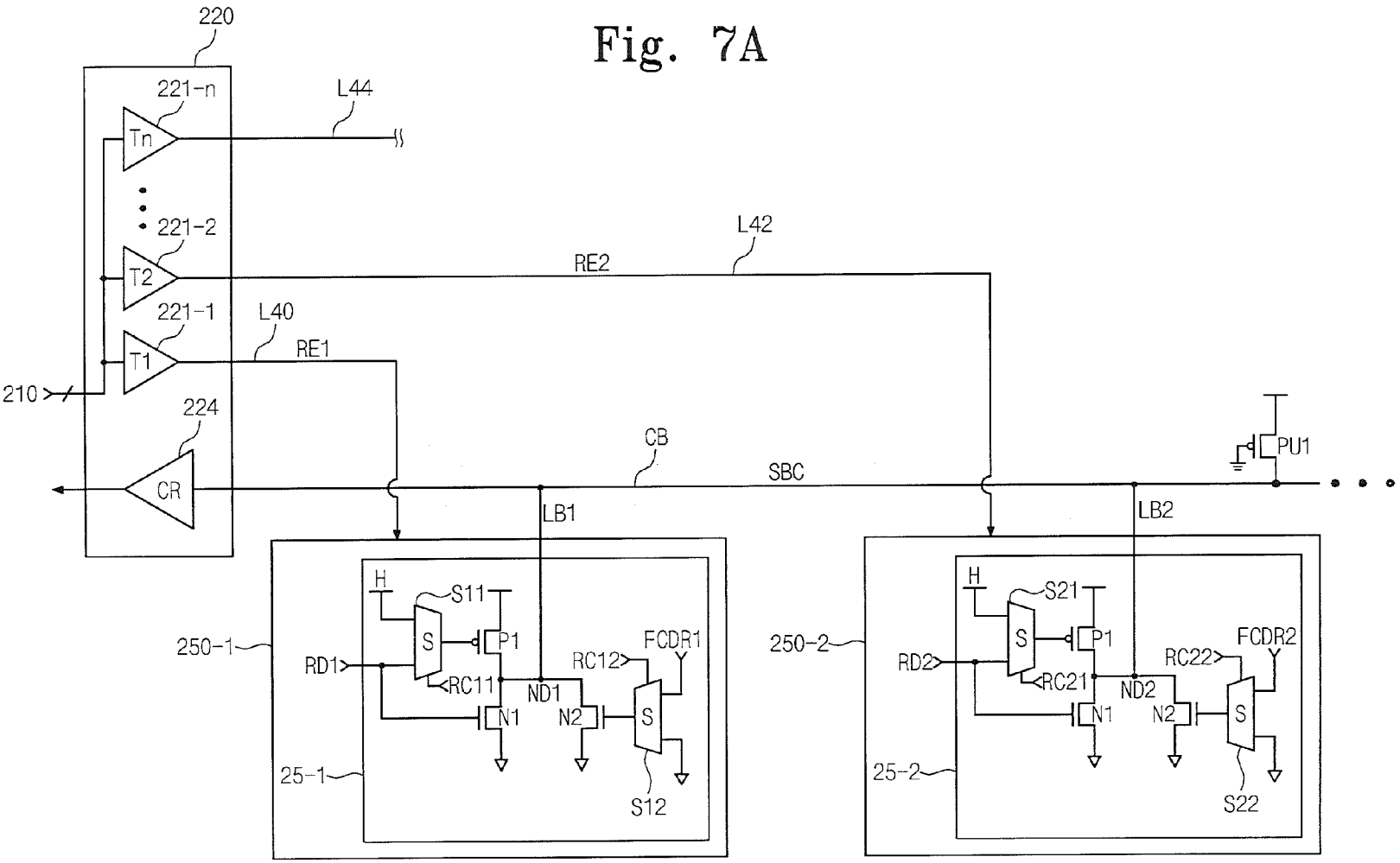
FIG. 7A is an electrical schematic illustrating a plurality of source drivers electrically coupled by a common bus to a timing control circuit, according to an embodiment of the present invention.

FIG. 7A is a circuit diagram of a plurality of source drivers 250-1, 250-2, . . . , **250-*n*, which includes a corresponding plurality of driver circuits 25-1 and 25-2 as shown by FIG. 2. The driver circuits 25-1 and 25-2 may have two modes of operation and may be controlled at least partially by the timing controller 220. Referring to FIG. 7A, a first driver circuit 25-1 may include three MOS transistors and two selectors (e.g., multiplexers). The first driver circuit 25-1 for data transmission may include a first MOS transistor N1 having a drain connected to the common bus CB via node ND1 and local bus LB1, a source that is grounded and a gate connected to receive a first input signal RD1. A second MOS transistor N2 is also provided, which has a drain connected to the common bus CB via node ND1 and a source that is grounded. A third PMOS transistor P1 is provided, which has a drain connected to the common bus CB via node ND1 and a source connected to a power supply voltage (e.g., Vdd). A first selector/multiplexer S11 is provided, which selects one of the first input and a second input according to a state of a first read control signal RC11. The first selector S11 has an output connected to a gate terminal of the third PMOS transistor P1. This first read control signal RC12 may correspond to the externally-applied read enable signal RE1, which may be provided by the timing controller 220. A second selector/multiplexer S12 is also provided, which selects one of a third input FCDR1 and a fourth input according to a state of the second read control signal RC12, which may correspond to the applied read enable signal RE1. This second selector S12 has an output connected to a gate of the second MOS transistor N2**.

In FIG. 7A, the signal RD1 may be treated as a read-out data signal and the signal FCDR1 may be treated as a soft fail signal that designates the locked or unlocked status of an internal clock. The first and second MOS transistors N1 and N2 may be n-channel MOS field effect transistors and the third MOS transistor P1 may be a p-channel MOS field effect transistor. Moreover, in the event the second input to the first selector S11 is fixed to a first logic state (e.g., logic 1=Vdd), the fourth input to the second selector S12 may be fixed to a second logic state (e.g., logic 0=Gnd), however, alternative fixed states may be used according to additional embodiments of the invention.

A second driver circuit 25-2 for data transmission may include a first MOS transistor N1 having a drain connected to the common bus CB via node ND2 and local bus LB2, a source that is grounded and a gate connected to receive a first input signal RD2. A second MOS transistor N2 is also provided, which has a drain connected to the common bus CB via node ND2 and a source that is grounded. A third PMOS transistor P1 is provided, which has a drain connected to the common bus CB via node ND2 and a source connected to a power supply voltage (e.g., Vdd). A first selector/multiplexer S21 is provided, which selects one of the first input and a second input according to a state of a read control signal RC21. The first selector S21 has an output connected to a gate terminal of the third PMOS transistor P1. This read control signal RC21 may correspond to the externally-applied read enable signal RE1, which may be provided by the timing controller 220. A second selector/multiplexer S22 is also provided, which selects one of a third input FCDR2 and a fourth input according to a state of the read control signal RC22, which may correspond to the applied read enable signal RE1. This second selector S22 has an output connected to a gate of the second MOS transistor N2. In FIG. 7A, the signal RD2 may be treated as a read-out data signal and the signal FCDR2 may be treated as a soft fail signal that designates the locked or unlocked status of an internal clock.

Operation of the multi-function driver circuit of FIG. 7A will now be described. Each of the read control signals RC11, RC12, RC21, RC22 provided to the select terminals of the selectors/multiplexers S11, S12, S21, S22 in the first and second drivers 25-1, 25-2, respectively, may be inactivated during a monitoring mode of operation and may be independently activated one-at-a-time during a data read mode of operation. If the read control signals RC11, RC12 are inactivated during the monitoring mode, the first selector S11 within the first driver circuit 25-1 may select the second input and thereby pass a high state signal (e.g., Vdd) to the gate of the third MOS transistor P1 to thereby maintain the third MOS transistor P1 in an "off" state. In addition, the second selector S12 within the first driver circuit 25-1 may select the third input and thereby pass a soft fail signal input to the gate of the second MOS transistor N2. As a result, when the input signals RD1 and FCDR1 are logically low during the monitoring mode of operation, the first and second MOS transistors N1 and N2 may be turned off along with the third MOS transistor P1, which enables the node ND1 (and common bus CB) to be held "weakly" at a pre-charged voltage level by a PMOS pull-up transistor P111. Thus, in the event a clock of a clock recovery unit within the first source driver 250-1 is locked (i.e., properly synchronized), the input signals RD1 and FCDR1 may have logical low levels, which means that first data having a logical high state is maintained at a pre-charged level on the common bus CB. On the other hand, when the input signal FCDR1 is logically high, the second MOS transistor N2 will be turned on (regardless of the value of RD1). In this case, a potential of the node ND1 will be pulled-down (i.e., discharged) to a ground voltage level (e.g., Gnd), which means that first data having a logical low state appears at the common bus CB. As described more fully hereinbelow, in the event a clock of a clock recovery unit is unlocked (e.g., out-of-sync), the corresponding input signal FCDR1 may have a logical high level, which means that the first data having the logical low state is transferred to the common bus CB to thereby reflect the unlocked status of the clock within the first source driver 250-1. Moreover, if the first data of a logical low state is provided onto the shared back channel during the monitoring mode, a timing controller 220 having the common receiver 224 therein may recognize the clock as being un-locked, and may provide (or continued to provide) a training clock to a corresponding source driver(s). Thus, during the first mode of operation, a locking state signal indicating a locked/unlocked state of a clock recovery unit within a source driver may be transmitted via the common bus CB.

In contrast, if the read control signals RC11 and RC12 are activated during a data read mode of operation (i.e., the second mode of operation), the first selector S11 may select the first input (i.e., signal RD1) and output it to the gate of the third MOS transistor P1. The third MOS transistor P1 may be turned on or off according to a logic state of the first input RD1. The first and third MOS transistors N1 and P1 may constitute a CMOS inverter INV. The second selector S12 may also select the fourth input (e.g., a logical low level) and output it to the gate of the second MOS transistor N2. Accordingly, the second MOS transistor N2 may be turned off. Accordingly, when the input signal RD1 is logically low, the first MOS transistor N1 may be turned off, while the third MOS transistor P1 may be turned on. This may mean that the node ND1 is driven to a power supply voltage (e.g., Vdd) by the PMOS transistor P1, which means that second data having a logical high state may appear on the common bus CB. But, when the input signal RD1 is logically high, the first MOS transistor N1 may be turned on, while the third MOS transistor P1 may be turned off. This will cause the node ND1 to be pulled down to a logic 0 voltage level (e.g., Gnd) because the pull-down strength of the first MOS transistor N1 is greater than the pull-up strength of the PMOS pull-up transistor PU1. Thus, during the data read mode of operation, the common receiver 224 within the timing controller 220 may receive the second data as an inverted version of the first input RD1 of the selected driver (e.g., 25-1, 25-2, . . . , **25-*n***), via the common bus (i.e., shared back channel SBC). This second data may be bit error rate (BER) test data, panel touch data, brightness data, temperature data or other data stored within the corresponding source driver.

Figure 7B:
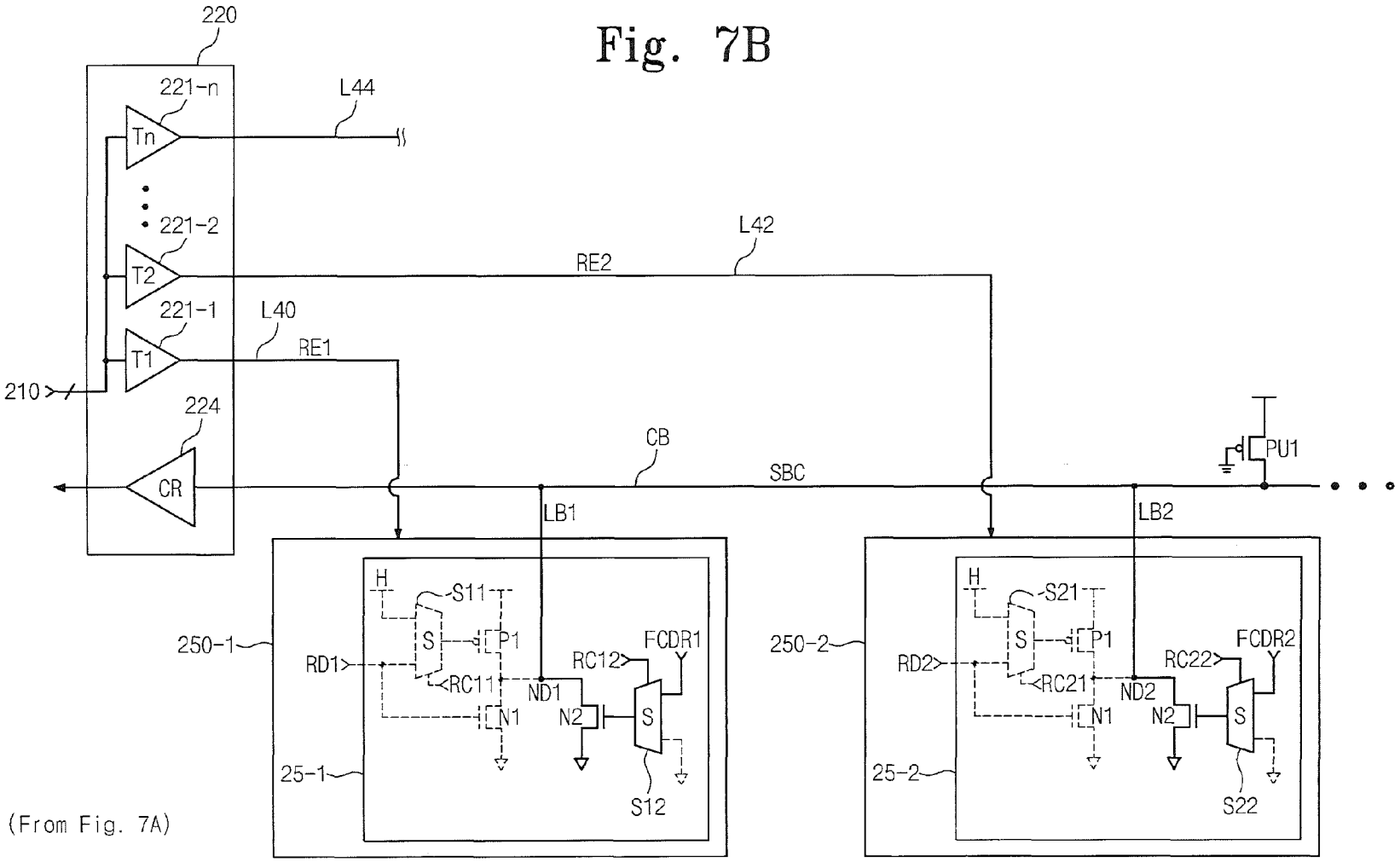
FIG. 7B is an electrical schematic of the plurality of source drivers of FIG. 7A, with selective components removed to highlight operation of the source drivers during a monitoring mode of operation.

FIG. 7B illustrates components of a display driver circuit according to additional embodiments of the invention during a first monitoring mode of operation when each of the source drivers 250-1, 250-2, . . . , **250-*n* is receiving a respective training clock. These training clocks support synchronization of clock signals within the source drivers 250-1, 250-2, . . . , 250-*n*. In contrast to the embodiment of FIG. 7A, the timing controller 220 of FIG. 7B is illustrated as including a common receiver 224 having an input terminal electrically coupled to the common bus (CB), which operates as a shared back-channel SBC, and a plurality of transmitters 221-1, 221-2, . . . , 221-*n*. These transmitters have input terminals electrically coupled to an input bus 210 and output terminals connected to respective signal lines L40, L42, . . . , L44, which provide respective read enable signals RE1, RE2, . . . , REn to the source drivers 250-1, 250-2, . . . , 250-*n*. As shown by FIG. 7B, elements of the drivers 25-1, 25-2, . . . , 25-*n* of FIG. 7A which are inactive in response to inactive read control signals (i.e., RC11, RC12, RC21, RC22, . . . =0) have been omitted from view. Each of the input signals FCDR1, FCDR2, . . . , is provided to NMOS pull-down transistor N2, which means the common bus CB will be pulled low from a "weakly" pre-charged logic 1 voltage level whenever one (or more) of the input signals FCDR1, FCDR2, . . . , is set to a logic 1 value to reflect the unlocked status of a clock within a corresponding source driver 250-1, 250-2, . . . , 250-*n*. The maintenance of a sustained logic 0 voltage level on the common bus CB during the monitoring mode of operation (i.e., when RE1, RE2, . . . , REn=0) will result in a sustained generation of a training clock to each of the source drivers until the common bus CB is returned to a logic 1 voltage level. This return to a logic 1 voltage level will occur when all input signals FCDR1, FCDR2, . . . , FCDRn are switched to logic 0 voltage levels to thereby turn off the NMOS pull-down transistor N2 within each of the drivers 25-1, 25-2, . . . , 25-*n* and demonstrate that all the corresponding clocks within the source drivers (250-1, 250-2, . . . , 250-*n***) have been sufficiently trained (i.e., synchronized).

Figure 8A:
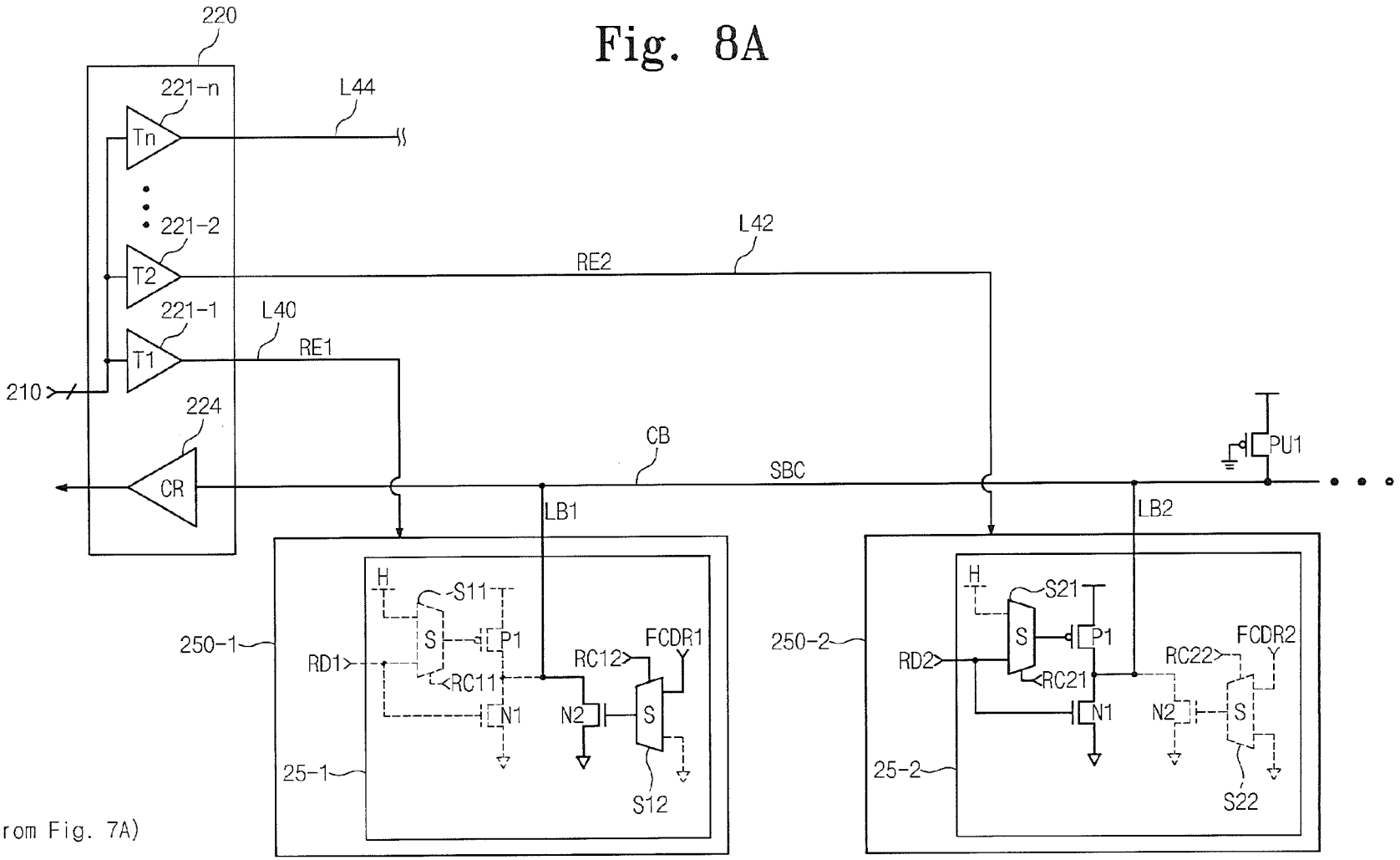
FIG. 8A is an electrical schematic of the plurality of source drivers of FIG. 7A, with selective components removed to highlight operation of one of the source drivers during a data read mode of operation.

FIG. 8A illustrates how the clock training operation described with respect to FIG. 7B can be followed by an operation to read data (e.g., bit error rate (BER) test data, panel touch data, brightness data, temperature data, etc.) from the second driver 25-2 within the second source driver 250-2 concurrently with monitoring a status of a clock within the first source driver 250-1 (and other source drivers). These modes of operation can be achieved by driving the first source driver 250-1 with an inactive read enable signal RE1, which may be translated as inactive read control signals RC11, RC12 within the first source driver 250-1, while concurrently driving the second source driver 250-2 with an active read enable signal RE1, which may be translated as active read control signal RC21, RC22 within the second source driver 250-2. The active read control signal RC21 will enable operation of an inverter (i.e., the PMOS pull-up transistor P1 and NMOS pull-down transistor N1) because the active read control signal RC21 will support the passing of the input signal RD2 through the selector/multiplexer S21 to the gate terminal of the PMOS transistor P1 (while simultaneously maintaining an NMOS pull-down transistor N2 in an off state by passing a logic 0 voltage signal (e.g., Gnd) through the selector/multiplexer S22 (not shown in FIG. 8A)). Accordingly, so long as the input signal FCDR1 within the first source driver 250-1 is maintained at a logic 0 voltage level to thereby reflect continuous synchronization of a clock therein, the input terminal of the common receiver 224 within the timing controller 220 will be driven with read data from the second source driver 250-2 (e.g., CB=/RD2).

Figure 8B:
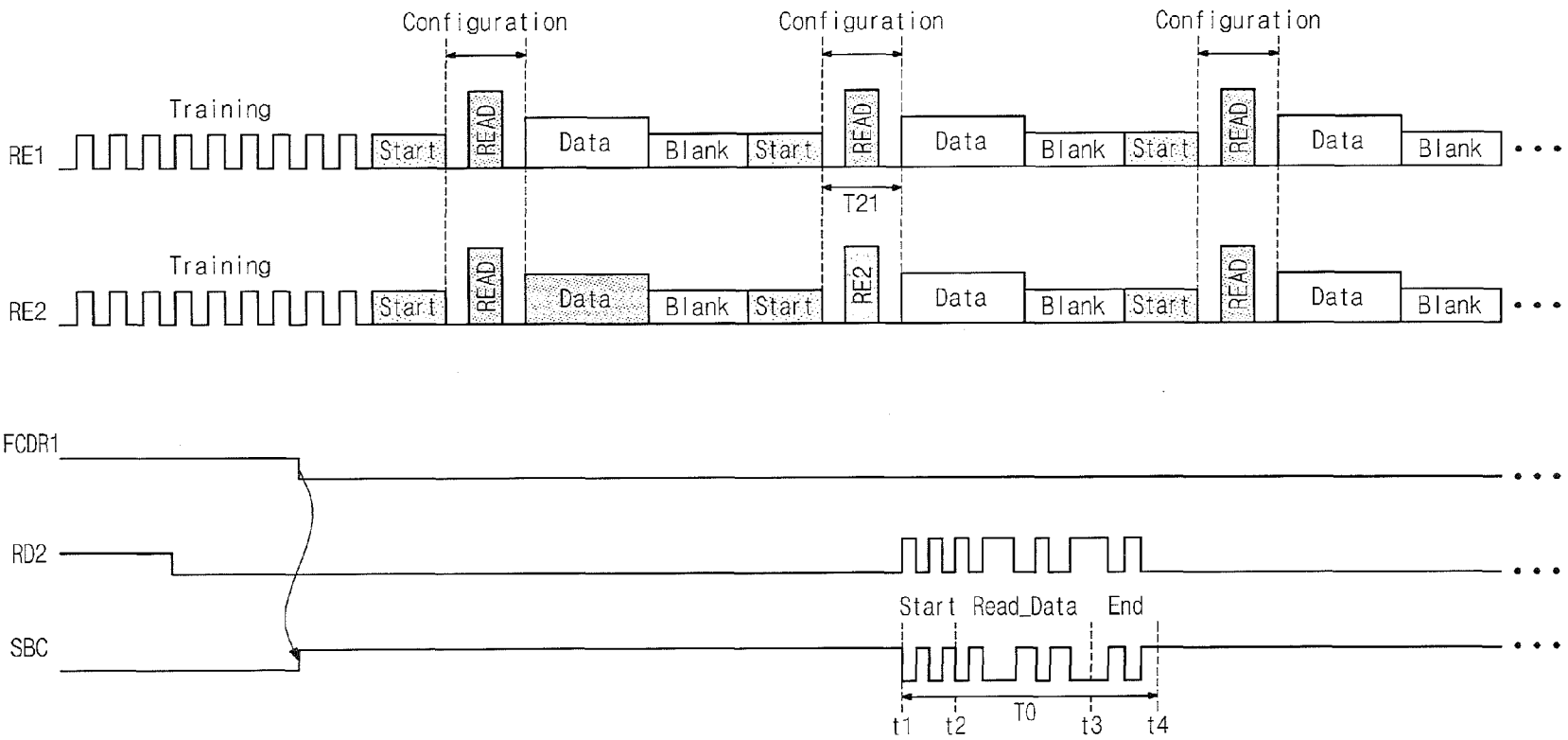
FIG. 8B is a timing diagram that illustrates timing of signals RD1, RD2 and SBC from FIG. 8A during an operation to train a plurality of source drivers followed by an operation to read data from a second source driver.
Figure 8C:
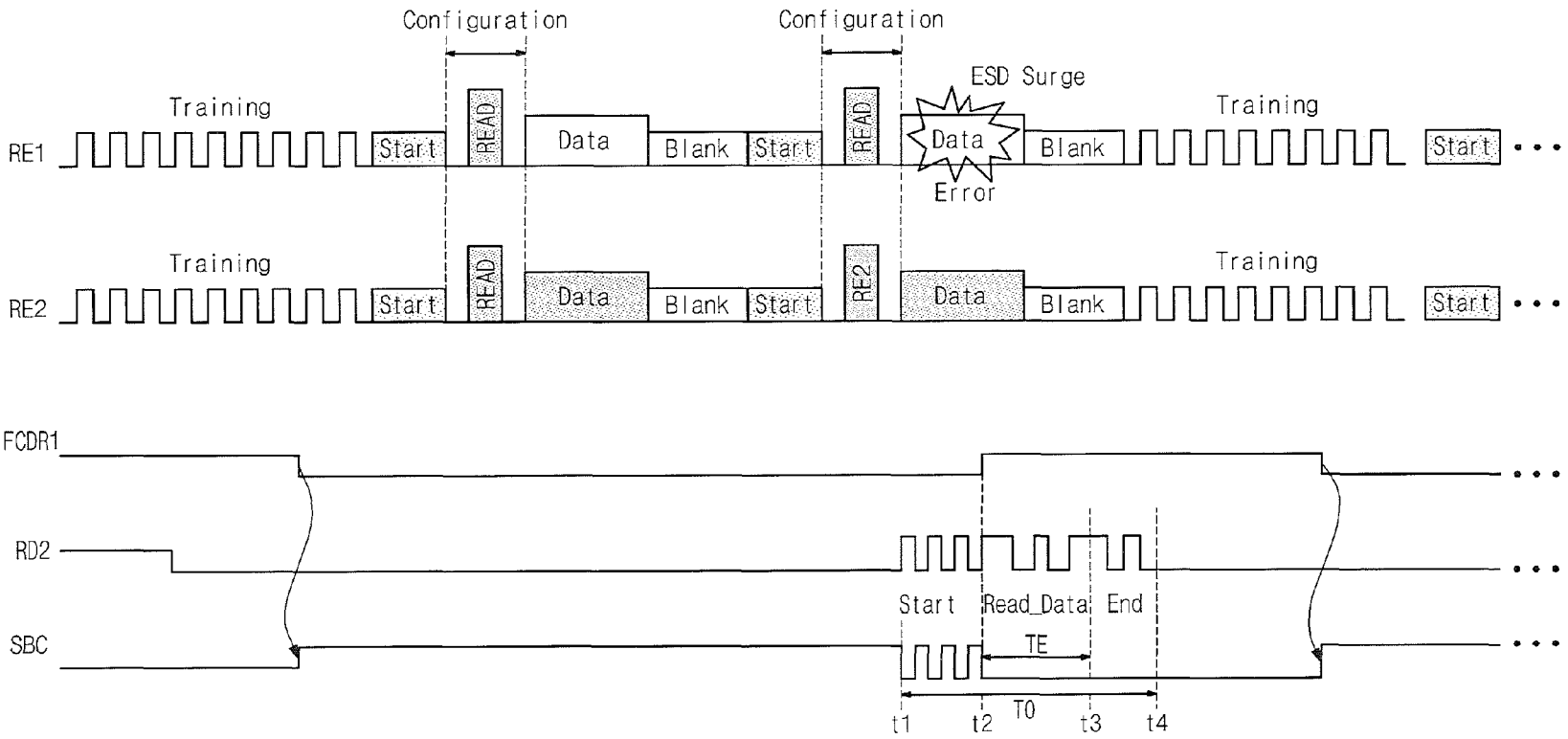
FIG. 8C is a timing diagram that illustrates timing of signals RD1, RD2 and SBC from FIG. 8A during an operation to train a plurality of source drivers followed by an operation to read data from a second source driver during an ESD surge event.

FIGS. 8B-8C are timing diagrams that illustrate the timing of the operations described above with respect to FIG. 8A, during which read data (/RD2) is provided from the second source driver 250-2 to the shared back channel SBC (i.e., the common bus CB) in response to an active read enable signal RE2. As shown by FIG. 8B, the source drivers 250-1, 250-2, . . . , **250-*n* are responsive to respective training clocks during a monitoring mode of operation when the read enable signals RE1, RE2, . . . , REn are held at logic 0 voltage levels (i.e., inactive). In response to these training clocks, internal clock signals (e.g., PLL clock signals) within the source drivers are synchronized. Once the last of the internal clock signals is synchronized, the shared back channel SBC switches from a logic 0 voltage level to a logic 1 voltage level by virtue of the pull-up strength of the PMOS pull-up transistor PU1 and the fact that all input signals RD1, RD2, . . . , RDn, FCDR1, FCDR2, . . . , FCDRn have been set to logic 0 voltage levels to thereby turn off the NMOS pull-down transistors N1 and N2 within the drivers 25-1, 25-2, . . . , 25-*n*. Thereafter, upon activation of the read enable signal RE2 during time interval T21, a data read operation from the second driver 25-2 commences during the time interval T0 (i.e., from time point t1 to time point t4). During this data read operation, header information (start), data (Read_Data) and footer information (end) is provided onto the shared back channel SBC at time points t1, t2 and t3, respectively. The header and footer information is provided as a relatively short alternating sequence of logic 1 and logic 0 data bits in order to enable the timing controller 220 to confirm commencement and termination of a valid data read interval (T0) associated with the active read enable signal RE2. However, as shown by the 0-to-1 transition of the signal FCDR1 during time interval T0 in FIG. 8C, if an erroneous event (e.g, ESD surge) occurs, which results in any clock within the source drivers 250-1, 250-2, . . . , 250-*n* becoming out-of-sync, the sustained logic 0 value on the shared back channel SBC during the time interval T0 will be properly interpreted as invalid data by the timing controller 220 (e.g., by virtue of the missing footer containing alternating logic 1 and logic 0 data bits). In response to the missing footer during the time interval from time point t3 to time point t4, the timing controller 220 will reinstate a monitoring mode of operation during which a previously enabled read enable signal is inactivated (i.e., RE1, RE2, . . . , REn=0). During this monitoring mode of operation, respective training clocks are once again provided to the source drivers 250-1, 250-2, . . . , 250-*n*** until all clocks are resynchronized and the shared back channel SBC is again reset to a logic 1 voltage level.

FIG. 9 is a block diagram schematically illustrating a display device according to an embodiment of the inventive concept. Referring to FIG. 9, a display device 200 may include a system controller 210, a timing controller 220, a gate driver 240, a source driver 250, a gamma voltage generator 260, and a display panel 280. A power supply 230 may be connected with the system controller 210 via a line L12 and may generate various voltages P1, P2, and P3 for the display device 200. As will be understood by those skilled in the art, the system controller 210 may provide the timing controller 220 with vertical and horizontal synchronization signals Vsync and Hsync, a clock signal DCLK, a data enable signal DE, data (RGB data values), etc. The power supply 230 may boost or reduce a voltage of 3 Volts to thereby generate a voltage(s) to be supplied to the panel 280. The power supply 230 may make a DC/DC conversion and may generate a gamma reference voltage, a gate high voltage VGH, a gate low voltage VGL, a driving power voltage, and a common voltage Vcom.

The panel 280 may be implemented as a liquid crystal display and may include a plurality of liquid crystal cells Clc arranged at intersections of data lines D1 through Dn and gate lines G1 through Gm. A TFT data transistor (DT) of each liquid crystal cell Clc may provide a corresponding liquid crystal cell Clc with a data signal supplied from a corresponding data line in response to a scan signal from a gate line Gi. A storage capacitor Cst may be formed at each liquid crystal cell Clc. The storage capacitor Cst may be formed between a pixel electrode of the liquid crystal cell Cls and a gate line of a front stage or between a pixel electrode of the liquid crystal cell Cls and a common electrode line to thereby retain a voltage of the liquid crystal cell Clc constantly.

Alternatively, the panel 280 may be an organic light emitting display panel or a plasma display panel, for example. The timing controller 220 may generate a gate control signal GCS and a data control signal DCS for controlling the gate driver 240 and the source driver 250 using the vertical and horizontal synchronization signals Vsync and Hsync, the clock signal DCLK, and the data enable signal DE from the system controller 210. Herein, the gate control signal GCS for controlling the gate driver 240 may include a gate start pulse GSP, a gate shift clock GSC, and a gate output enable signal GOE. The data control signal DCS for controlling the source driver 250 may include a source start pulse SSP, a source shift clock SSC, a source output enable signal SOE, and a polarity signal POL. The timing controller 220 may align data (e.g., RGB data) provided from the system controller 210 to output it to the source driver 250 via a data line L16.

The gamma voltage generator 260 may generate a gamma voltage using a driving voltage from the power supply 230 to supply it to the source driver 250. The source driver 250 may perform a driving operation in response to the data control signal DCS from the timing controller 220. The source driver 250 may output different levels of gamma voltages according to a gradation value of data input via a line L16. As a result, a current value may be determined according to a gradation value of data, and the determined current value may be supplied to data lines D1 through Dn as an analog signal.

The gate driver 240 may sequentially supply a scan pulse, that is, a gate high voltage VGH to gate lines G1 through Gm in response to the gate control signal GCS from the timing controller 220. Accordingly, as a horizontal line of the panel 280 is selected, an image may be displayed via the panel 280 according to data applied via a vertical line.

In an embodiment, a soft fail signal and data read out from an internal circuit block may be backward transmitted via a shared back channel, which operates as a common bus CB connected between the source driver 250 and the timing controller 220. Accordingly, in the event the system controller 210 is connected with an external test device, bit error rate test data or panel touch data read out from an internal circuit block may be transferred to the external test device. Furthermore, if the timing controller 220 receives temperature data output from a temperature sensor or brightness data output from a color sensor via the shared back channel, then compensation for chromaticity coordinates or brightness may be controlled appropriately.

Figure 10:
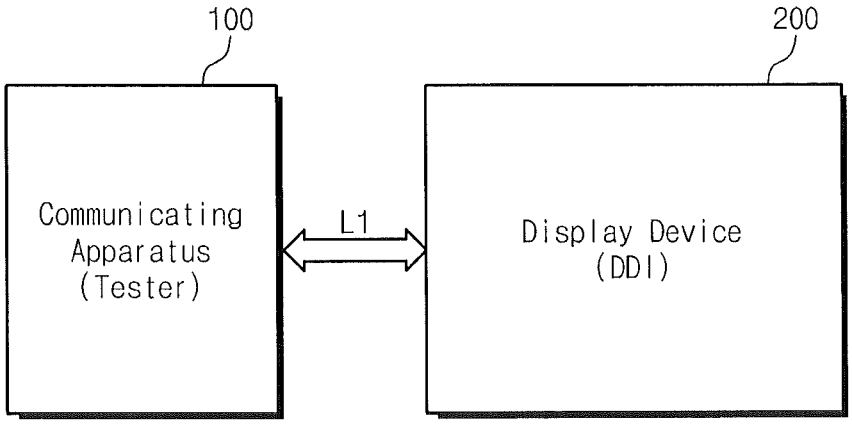
FIG. 10 is a block diagram schematically illustrating a connection relationship between a communicating apparatus and a display device in FIG. 9.

FIG. 10 is a block diagram schematically illustrating connection relation between a communicating apparatus and a display device in FIG. 9. Referring to FIG. 10, a display device 200 may be connected with a communicating apparatus 100 via a system bus L1. The communicating apparatus 100 may be a DVD player, a computer, a set top box (STB), a game machine, a digital camcorder, a processor of a mobile phone, for example. In the event the display device 200 is a monitor and the communicating apparatus 100 is a computer, data provided from storage of the computer may be displayed on the monitor. The storage may be used to store data information having various data format such as text, graphic, software code, etc. The storage, for example, an Electrically Erasable Programmable Read-Only Memory (EEPROM), a flash memory, a Magnetic RAM (MRAM), a Spin-Transfer Torque MRAM, a Conductive bridging RAM (CBRAM), a Ferroelectric RAM (FeRAM), a Phase change RAM (PRAM) called an Ovonic Unified Memory (OUM), a resistive RAM (RRAM or ReRAM), a nanotube RRAM, a Polymer RAM (PoRAM), a Nano Floating Gate Memory (NFGM), a holographic memory, a molecular electronics memory device, an insulator resistance change memory, or the like.

The computer may include a CPU, a RAM, a user interface, a modem including baseband chipset, and a memory system. The CPU of the computer may be installed by a type of multi-processor. In this case, it is possible to escape installing of RAM in each processor. Accordingly, the RAM may include a multi-port and a shared memory region so as to be shared by processors. Although not shown in figures, the computer may further include an application chipset, a camera image processor (CIS), a mobile DRAM, etc. A memory and/or a memory controller of the memory system may be packaged using various packages such as PoP (Package on Package), Ball grid arrays (BGAs), Chip scale packages (CSPs), Plastic Leaded Chip Carrier (PLCC), Plastic Dual In-Line Package (PDIP), Die in Waffle Pack, Die in Wafer Form, Chip On Board (COB), Ceramic Dual In-Line Package (CERD1P), Plastic Metric Quad Flat Pack (MQFP), Thin Quad Flatpack (TQFP), Small Outline (SOIC), Shrink Small Outline Package (SSOP), Thin Small Outline (TSOP), System In Package (SIP), Multi Chip Package (MCP), Wafer-level Fabricated Package (WFP), Wafer-Level Processed Stack Package (WSP), etc.

In FIG. 10, if the communicating apparatus 100 is used as a tester for testing the display device 200, a computer of the communicating apparatus 100 may receive bit error rate test data or panel touch data from a controller of the display device 100. Furthermore, the computer of the communicating apparatus 100 may occasionally receive temperature data output from a temperature sensor or brightness data output from a color sensor.

Figure 11:
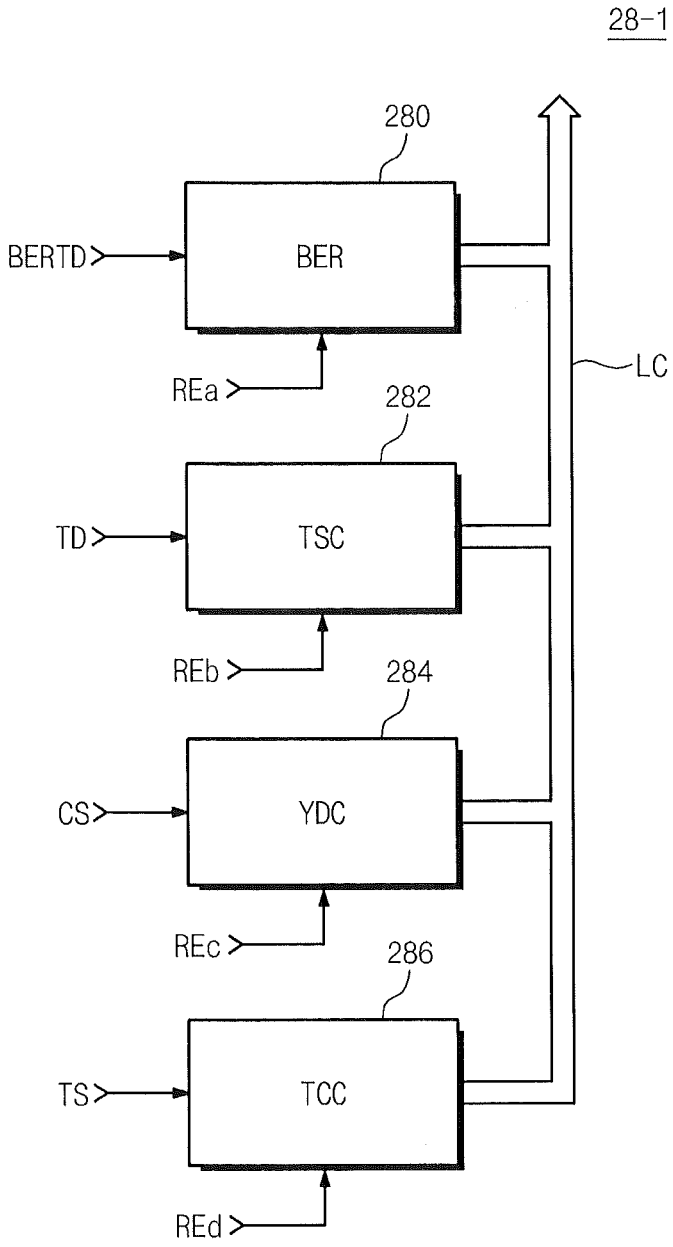
FIG. 11 is a block diagram schematically illustrating an internal circuit in FIG. 4 according to an embodiment of the inventive concept.

FIG. 11 is a block diagram schematically illustrating an internal circuit in FIG. 4 according to an embodiment of the inventive concept. Referring to FIG. 11, an internal circuit 28-1 may include a circuit 280 outputting bit error rate (BER) test data, a circuit 282 outputting panel touch data generated from a touch screen of a panel, a circuit 284 outputting brightness data sensed from a color sensor, and a circuit 286 outputting temperature data sensed from a temperature sensor. If a controller receives the BER test data from the circuit 280, it may transmit the received data to an external test apparatus. The external test apparatus may make BER test on a display device without separate channels. If the controller receives the panel touch data from the circuit 282, it may transmit the received data to the external test apparatus. The external test apparatus may perform a test operation associated with panel touch on a display device without separate channels.

A touch system capable of being installed at a front stage of the circuit 282 may include a touch screen panel including a plurality of sensing units and a signal processing unit generating touch data in response to a capacitance variation of a sensing unit of the touch screen panel. A parasitic capacitance component may exist at the sensing units of the touch screen panel. Such parasitic capacitance component may include a horizontal capacitance component generated among sensing units and a vertical capacitance component generated between a sensing unit and a display panel. If a total parasitic capacitance value is large, a variation of a capacitance due to a touch with a finger or a touch pen may be relatively small as compared with the parasitic capacitance. For example, as a finger or a touch pen approaches a sensing unit, a capacitance value of the sensing unit may increase. Although the sensing unit is a relatively large parasitic capacitance value, its sensitivity can be lowered. A variation of a common electrode voltage VCOM provided to a top plate of a display panel may cause generation of a sensing noise of a touch operation via a vertical parasitic capacitance. Accordingly, in the event a test is performed (e.g., by an external test apparatus) to determine whether a touch system is operating normally or abnormally, data transmission according to an embodiment of the inventive concept may be advantageous. If the controller receives the brightness data output from the circuit 284, it is possible to compensate the brightness by comparison with reference brightness data. If the controller receives the temperature data output from the circuit 286, it is possible to compensate chromaticity coordinates according to a temperature variation referring to a temperature characteristic table.

Figure 12:
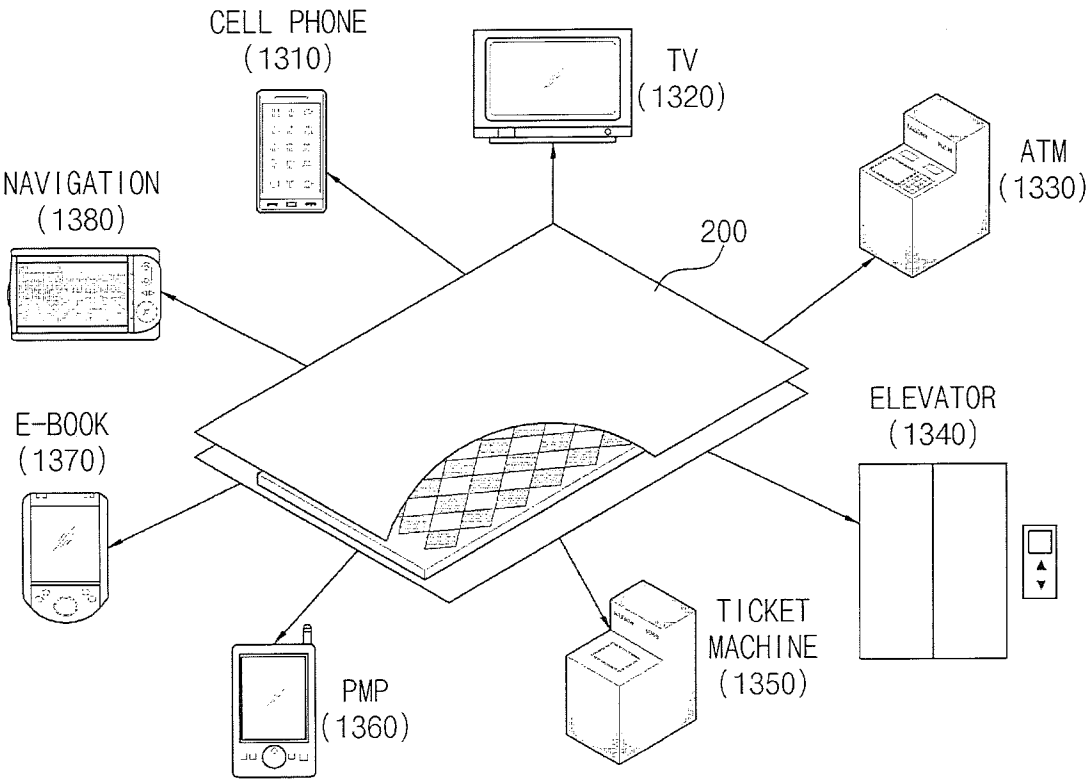
FIG. 12 is a block diagram of an application of the inventive concept which is applied to various display devices.

FIG. 12 is a block diagram of an application of the inventive concept which is applied to various display devices. Referring to FIG. 12, a display device 200 may be applied to a cellular phone 1310, a LCD or PDP TV 130, an ATM machine 1330, an elevator 1340, a ticket machine 1350, a PMP 1460, an e-book 1370, a navigation 1380, for example. Of all applications necessitating a user interface, the display device 200 may include a system using a touch screen. In particular, in case of a cellular phone, adoption of the touch screen system may be effective.

The display device 200 may transfer a soft fail signal and read-out data generated within a device to a timing controller via a shared back channel. Since a controller of a device receives panel test data and internal data generated by an internal circuit via a shared back channel without the addition of separate lines, appropriate control may be made. For example, when connected with an external test device, the controller may receive BER test data read out from an internal circuit block or panel touch data via the shared back channel in order to send it to a test device. Further, if the controller receives temperature data output from a temperature sensor or brightness data output from a color sensor, it is possible to compensate chromaticity coordinates or brightness.

The above-disclosed subject matter is to be considered illustrative, and not restrictive, and the appended claims are intended to cover all such modifications, enhancements, and other embodiments, which fall within the true spirit and scope. Thus, to the maximum extent allowed by law, the scope is to be determined by the broadest permissible interpretation of the following claims and their equivalents, and shall not be restricted or limited by the foregoing detailed description. For example, a shared back channel driver, a data transfer mode, a data transfer format, for example, may be changed or modified variously.

What is claimed is:

1. A display driver circuit, comprising:

a first multi-function driver configured to support a first mode of operation in response to a first control signal through a single line by driving a bus with a first output signal having a value that indicates a locked or unlocked status of a first clock signal therein and further configured to support a second mode of operation in response to a second control signal through a single line by driving the bus with first data unrelated to the locked or unlocked status of the first clock signal, said first data formatted to include, in sequence, a start-data header, read-out data and an end-data footer having an alternating bit signature: and a timing controller configured to provide a first training clock to said first multi-function driver in response to receiving the first output signal having a value that indicates an unlocked status of the first clock signal, said unlocked status reflected by a missing end-data footer following detection by said timing controller of a start-data header associated with the first data.

2. The display driver circuit of claim 1, wherein the first data is a multi-bit stream of data.

3. The display driver circuit of claim 1, further comprising:

a second multi-function driver configured to support the first mode of operation in response to a third control signal by driving the bus with a second output signal having a value that indicates a locked or unlocked status of a second clock signal therein and further configured to support the second mode of operation in response to a fourth control signal by driving the bus with second data unrelated to the locked or unlocked status of the second clock signal; and wherein said timing controller is configured to provide a second training clock to said second multi-function driver concurrently with providing a first training clock to said first multi-function driver in response to detecting absence of a missing end-data footer comprising an alternating bit footer sequence, which follows detection by said timing controller of a start-data header associated with either the first data or the second data.

4. The display driver circuit of claim 3, wherein the bus comprises a shared back channel signal line; and wherein said first and second multi-function drivers are configured to drive the shared back channel signal line with the first and second output signals, respectively, during the first mode of operation.

5. The display driver circuit of claim 4, wherein said first and second multi-function drivers are electrically connected to the shared back channel signal line in a wired-OR configuration.

6. The display driver circuit of claim 3, wherein the first and second control signals are provided as inactive and active states of a first read enable signal or vice versa; and wherein the third and fourth control signals are provided as inactive and active states of a second read enable signal or vice versa.

7. The display driver circuit of claim 4, wherein said first multi-function driver is configured to support the second mode of operation by driving the shared back channel signal line with the first data.

8. The display driver circuit of claim 5, wherein said first multi-function driver is configured to support the second mode of operation by driving the shared back channel signal line with the first data.

9. The display driver circuit of claim 7, wherein said first multi-function driver is configured to support the second mode of operation by driving the shared back channel signal line with a stream of data relating to at least one of touch sensor data, ambient light sensor data, temperature sensor data and bit error count data.

10. The display driver circuit of claim 1, wherein the start-data header has an alternating bit signature that is equivalent to the alternating bit signature of the end-data footer.

11. The display driver circuit of claim 3, wherein the start-data header is an alternating bit sequence that is equivalent to the alternating bit footer sequence.

12. The display driver circuit of claim 1, wherein the first multi-function driver comprises:

a first MOS transistor having a drain connected to the bus, a source grounded, and a gate connected to receive a first input;

a second MOS transistor having a drain connected to the bus and a source grounded;

a third MOS transistor having a drain connected to the bus and a source connected to a power supply voltage;

a first selector configured to select one of the first input and a second input in response to a state of a read control signal and to apply the selected input to a gate of the third MOS transistor; and a second selector configured to select one of a third input and a fourth input in response to a state of the read control signal and to apply the selected input to a gate of the second MOS transistor.

13. A method of operating a display device, comprising:

providing a training clock to a first multi-function driver circuit in response to detecting an unlocked status of a first clock generated therein via a common bus connected to an output of the first multi-function driver circuit, said unlocked status reflected by a missing end-data footer following detection of a start-data header on the common bus, said end-data footer having an alternating bit signature;

providing a first active read control signal to the first multi-function driver circuit in response to detecting a locked status of the first clock via the common bus; and transmitting first read data from the first multi-function driver circuit to the common bus in response to the first active read control signal, said first read data formatted to include, in sequence, the start-data header, read-out data and the end-data footer.

14. The method of claim 13, further comprising:

providing a training clock to a second multi-function driver circuit in response to detecting an unlocked status of at least one of a second clock generated therein and the first clock via a common bus connected to an output of the second multi-function driver circuit;

providing a second active read control signal to the second multi-function driver circuit in response to detecting a locked status of the first and second clocks via the common bus; and transmitting second read data from the second multi-function driver circuit to the common bus in response to the second active read control signal, said second read data formatted to include, in sequence, the start-data header, read-out data and the end-data footer.

15. The method of claim 14, wherein said providing the first active read control signal and said providing the second active read control signal are only performed one-at-a-time.

16. The method of claim 14, wherein said providing a training clock to a second multi-function driver circuit comprises providing first and second training clocks to the first and second multi-function driver circuits, respectively.

17. The method of claim 13, wherein the start-data header has an alternating bit signature that is equivalent to the alternating bit signature of the end-data footer.

* * * * *